US011814965B2

(12) United States Patent
Dyson et al.

(10) Patent No.: US 11,814,965 B2
(45) Date of Patent: Nov. 14, 2023

(54) TURBOMACHINE BLADE TRAILING EDGE COOLING CIRCUIT WITH TURN PASSAGE HAVING SET OF OBSTRUCTIONS

(71) Applicant: General Electric Company, Schenectady, NY (US)

(72) Inventors: Thomas Earl Dyson, Niskayuna, NY (US); Nicholas William Rathay, Rock City Falls, NY (US); Adam John Fredmonski, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/454,363

(22) Filed: Nov. 10, 2021

(65) Prior Publication Data

US 2023/0145370 A1 May 11, 2023

(51) Int. Cl.
*F01D 5/18* (2006.01)
*F01D 5/14* (2006.01)

(52) U.S. Cl.
CPC ..... *F01D 5/187* (2013.01); *F01D 5/147* (2013.01); *F05D 2240/304* (2013.01);
(Continued)

(58) Field of Classification Search
CPC ..... F01D 5/187; F01D 5/186; F01D 9/041; F01D 5/147; F01D 25/12; F01D 9/065;
(Continued)

(56) References Cited

U.S. PATENT DOCUMENTS 2,744,723 A 5/1956 Roush
3,220,697 A 11/1965 Smuland et al.
(Continued)

FOREIGN PATENT DOCUMENTS

CN 1461872 A 12/2003
CN 104379874 A 2/2015
(Continued)

OTHER PUBLICATIONS

EP Patent Application No. 17197311.8, Extended EP Search Report dated Jan. 29, 2018, 8 pages.
(Continued)

*Primary Examiner* — Eric J Zamora Alvarez
(74) *Attorney, Agent, or Firm* — James Pemrick; Charlotte Wilson; Hoffman Warnick LLC

(57) ABSTRACT

A turbomachine blade, and a coupon for a turbomachine blade, are disclosed. The blade may include an airfoil body having a pressure side and a suction side connected by a leading edge and a trailing edge, a coolant feed passage defined in the airfoil body, and a coolant reuse passage defined in the airfoil body. The blade may also include a first cooling circuit defined in the airfoil body. The first cooling circuit may include a rearward passage extending toward the trailing edge from and fluidly coupled to the coolant feed passage, and a radially spreading return passage extending away from the trailing edge toward and fluidly coupled to the coolant reuse passage. The cooling circuit may also include a radially extending turn passage coupling the rearward passage and the radially spreading return passage. A first set of obstructions may be positioned in the radially extending turn passage.

20 Claims, 14 Drawing Sheets

(52) U.S. Cl.
CPC .. *F05D 2260/202* (2013.01); *F05D 2260/232* (2013.01); *F05D 2260/608* (2013.01)

(58) Field of Classification Search
CPC ..... F01D 5/189; F01D 25/08; F01D 5/185; F01D 9/06; F01D 11/24; F01D 5/141; F01D 5/181; F01D 5/188; F05D 2240/304; F05D 2260/202; F05D 2240/122; F05D 2220/32; F05D 2250/185; F05D 2240/124; F05D 2240/306; F05D 2260/204; F05D 2240/123; F05D 2240/305; F05D 2260/205; F05D 2260/232; F05D 2260/608; F05D 2260/22141; F05D 2250/184; F05D 2250/183; F05D 2240/127; F04D 27/0207
See application file for complete search history.

(56) References Cited

U.S. PATENT DOCUMENTS

| | | | | |
|---|---|---|---|---|
| 3,844,679 | A | 10/1974 | Grondahl et al. | |
| 3,849,025 | A | 11/1974 | Grondahl | |
| 4,021,139 | A | 5/1977 | Franklin | |
| 4,302,153 | A | 11/1981 | Tubbs | |
| 4,684,322 | A | 8/1987 | Clifford et al. | |
| 4,761,116 | A | 8/1988 | Braddy et al. | |
| 4,940,388 | A | 7/1990 | Lilleker et al. | |
| 5,100,293 | A | 3/1992 | Anzai et al. | |
| 5,236,309 | A | 8/1993 | Van Heusden et al. | |
| 5,350,277 | A | 9/1994 | Jacala et al. | |
| 5,464,322 | A | 11/1995 | Cunha et al. | |
| 5,536,143 | A | 7/1996 | Jacala et al. | |
| 5,915,923 | A | 6/1999 | Tomita et al. | |
| 5,967,752 | A | 10/1999 | Lee et al. | |
| 5,997,251 | A | 12/1999 | Lee | |
| 6,099,252 | A * | 8/2000 | Manning | F01D 5/187 416/97 R |
| 6,227,804 | B1 | 5/2001 | Koga et al. | |
| 6,247,896 | B1 | 6/2001 | Auxier et al. | |
| 6,422,817 | B1 | 7/2002 | Jacala | |
| 6,499,949 | B2 | 12/2002 | Schafrik et al. | |
| 6,547,522 | B2 | 4/2003 | Turnquist et al. | |
| 6,547,525 | B2 | 4/2003 | Haehnle et al. | |
| 7,435,053 | B2 | 10/2008 | Liang | |
| 7,530,789 | B1 | 5/2009 | Liang | |
| 7,670,113 | B1 | 3/2010 | Liang | |
| 7,682,133 | B1 | 3/2010 | Liang | |
| 7,717,675 | B1 | 5/2010 | Liang | |
| 7,785,070 | B2 | 8/2010 | Liang | |
| 7,845,906 | B2 | 12/2010 | Spangler et al. | |
| 7,955,053 | B1 | 6/2011 | Liang | |
| 7,985,049 | B1 | 7/2011 | Liang | |
| 8,043,059 | B1 | 10/2011 | Liang | |
| 8,047,788 | B1 | 11/2011 | Liang | |
| 8,142,153 | B1 | 3/2012 | Liang | |
| 8,317,472 | B1 | 11/2012 | Liang | |
| 8,322,988 | B1 | 12/2012 | Downs et al. | |
| 8,398,370 | B1 | 3/2013 | Liang | |
| 8,444,386 | B1 | 5/2013 | Liang | |
| 8,562,295 | B1 | 10/2013 | Liang | |
| 8,608,430 | B1 | 12/2013 | Liang | |
| 8,628,298 | B1 | 1/2014 | Liang | |
| 8,678,766 | B1 | 3/2014 | Liang | |
| 8,790,083 | B1 | 7/2014 | Liang | |
| 8,864,469 | B1 * | 10/2014 | Liang | F01D 5/187 416/97 R |
| 9,145,780 | B2 | 9/2015 | Propheter-Hinckley et al. | |
| 9,447,692 | B1 * | 9/2016 | Liang | F01D 5/187 |
| 9,970,302 | B2 | 5/2018 | Lacy et al. | |
| 10,233,761 | B2 | 3/2019 | Snider et al. | |
| 10,240,465 | B2 | 3/2019 | Weber et al. | |
| 10,273,810 | B2 | 4/2019 | Weber et al. | |
| 10,301,946 | B2 | 5/2019 | Weber et al. | |
| 10,309,227 | B2 | 6/2019 | Weber et al. | |
| 10,352,176 | B2 * | 7/2019 | Weber | F01D 5/187 |
| 10,443,399 | B2 | 10/2019 | Jones et al. | |
| 10,450,875 | B2 | 10/2019 | Weber et al. | |
| 10,450,950 | B2 | 10/2019 | Weber | |
| 10,465,521 | B2 | 11/2019 | Snider et al. | |
| 10,577,944 | B2 | 3/2020 | Clark et al. | |
| 10,598,028 | B2 | 3/2020 | Hoskin et al. | |
| 2005/0058534 | A1 | 3/2005 | Lee et al. | |
| 2008/0050241 | A1 | 2/2008 | Liang | |
| 2008/0286115 | A1 | 11/2008 | Liang | |
| 2009/0028702 | A1 | 1/2009 | Pietraszkiewicz et al. | |
| 2009/0104042 | A1 | 4/2009 | Liang | |
| 2009/0185903 | A1 | 7/2009 | Beeck et al. | |
| 2009/0193657 | A1 | 8/2009 | Wilson, Jr. et al. | |
| 2010/0104419 | A1 | 4/2010 | Liang | |
| 2010/0226755 | A1 | 9/2010 | Liang | |
| 2010/0303625 | A1 | 12/2010 | Kuhne et al. | |
| 2013/0052035 | A1 | 2/2013 | Dutta et al. | |
| 2013/0108471 | A1 | 5/2013 | Fujimoto | |
| 2013/0272850 | A1 | 10/2013 | Bunker | |
| 2014/0093379 | A1 | 4/2014 | Tibbott et al. | |
| 2014/0127013 | A1 | 5/2014 | Spangler et al. | |
| 2014/0161626 | A1 | 6/2014 | Podgorski et al. | |
| 2015/0041590 | A1 | 2/2015 | Kirtley et al. | |
| 2015/0044059 | A1 | 2/2015 | Wassynger et al. | |
| 2015/0059357 | A1 | 3/2015 | Morgan et al. | |
| 2015/0096305 | A1 | 4/2015 | Morgan et al. | |
| 2015/0118034 | A1 | 4/2015 | Lee et al. | |
| 2015/0147164 | A1 | 5/2015 | Cui et al. | |
| 2015/0252728 | A1 | 9/2015 | Veiga | |
| 2015/0345303 | A1 | 12/2015 | Dong et al. | |
| 2016/0169003 | A1 | 6/2016 | Wong et al. | |
| 2016/0177741 | A1 | 6/2016 | Kirollos et al. | |
| 2016/0362985 | A1 | 12/2016 | Lacy et al. | |
| 2017/0044904 | A1 | 2/2017 | Bunker | |
| 2017/0234154 | A1 | 8/2017 | Downs | |
| 2017/0350259 | A1 | 12/2017 | Dutta et al. | |
| 2018/0230815 | A1 | 8/2018 | Jones | |
| 2021/0156265 | A1 | 5/2021 | Rathay et al. | |
| 2021/0215050 | A1 * | 7/2021 | Vandeputte | F01D 5/141 |

FOREIGN PATENT DOCUMENTS

| | | | |
|---|---|---|---|
| EP | 1361337 | A1 | 11/2003 |
| EP | 1533474 | A2 | 5/2005 |
| EP | 1793085 | A2 | 6/2007 |
| EP | 2562353 | A2 | 2/2013 |
| EP | 2754856 | A1 | 7/2014 |
| GB | 2260166 | A | 4/1993 |
| JP | S60198305 | A | 10/1985 |
| JP | S61279702 | A | 12/1986 |
| JP | H10231703 | A | 9/1998 |
| JP | H11107702 | A | 4/1999 |
| JP | 2000291406 | A | 10/2000 |
| JP | 2005030387 | A | 2/2005 |
| JP | 2005127314 | A | 5/2005 |
| JP | 2005155606 | A | 6/2005 |
| JP | 2016503850 | A | 2/2016 |
| JP | 2018021544 | A | 2/2018 |
| WO | 2012/092279 | A1 | 7/2012 |
| WO | 2014/055259 | A1 | 4/2014 |

OTHER PUBLICATIONS

EP Patent Application No. 17197845.5, Extended EP Search Report dated Mar. 13, 2018, 7 pages.
EP Patent Application No. 17197948.7, Extended EP Search Report dated May 17, 2018, 6 pages.
EP Patent Application No. 17198215.0, Extended EP Search Report dated Mar. 16, 2018, 8 pages.
EP Patent Application No. 17196197.2, Extended EP Search Report dated Mar. 7, 2018, 7 pages.
EP Patent Application No. 17197845.5, Communication pursuant to Article 94(3) EPC dated Dec. 6, 2018, 5 pages.
Chinese Patent Application No. 201711013675X, First Search, 2 pages.

(56) References Cited

OTHER PUBLICATIONS

Chinese Patent Application No. 2017110200879, First Search, 2 pages.
Chinese Patent Application No. 201711013675X, First Office Action, 8 pages.
Chinese Patent Application No. 2017110200879, First Office Action, 8 pages.
Japanese Patent Application No. 2017-200713, Decision to Grant a Patent, 2 pages.
Extended European Search Report dated Mar. 21, 2023 for Application 22192282.6; p. 7.
U.S. Appl. No. 15/334,450, Notice of Allowance dated Jan. 10, 2019, 12 pages.
U.S. Appl. No. 15/334,450, Office Action dated Aug. 15, 2018, 49 pages.
U.S. Appl. No. 15/334,471, Office Action dated Jul. 11, 2019, 13 pages.
U.S. Appl. No. 15/334,474, Notice of Allowance dated Apr. 17, 2019, 16 pages.
U.S. Appl. No. 15/334,474, Office Action dated Dec. 31, 2018, 13 pages.
U.S. Appl. No. 15/334,454, Notice of Allowance dated Jan. 24, 2019, 23 pages.
U.S. Appl. No. 15/334,563, Notice of Allowance dated Apr. 9, 2019, 8 pages.
U.S. Appl. No. 15/334,563, Office Action dated Dec. 12, 2018, 18 pages.
U.S. Appl. No. 15/334,585, Final Office Action dated Feb. 8, 2019, 20 pages.
U.S. Appl. No. 15/334,585, Notice of Allowance dated Jun. 7, 2019, 12 pages.
U.S. Appl. No. 15/334,585, Office Action dated Jul. 31, 2018, 22 pages.
U.S. Appl. No. 15/334,448, Notice of Allowance dated Jun. 19, 2019, 13 pages.
U.S. Appl. No. 15/334,448, Office Action dated May 14, 2019, 8 pages.
U.S. Appl. No. 15/334,501, Notice of Allowance dated Jan. 17, 2019, 11 pages.
U.S. Appl. No. 15/334,501, Office Action dated Aug. 10, 2018, 17 pages.
U.S. Appl. No. 15/334,517, Office Action dated Aug. 6, 2018, 24 pages.
U.S. Appl. No. 15/334,483, Office Action dated Jun. 28, 2018,13 pages.
U.S. Appl. No. 15/334,483, Notice of Allowance dated Jun. 20, 2019, 8 pages.
EP Patent Application No. 17198212.7, Extended EP Search Report dated May 23, 2018, 7 pages.
EP Patent Application No. 17197310.0, Extended EP Search Report dated Jan. 29, 2018, 8 pages.
Japanese Patent Application No. 2017-200044, Notice of Reasons for Refusal, 3 pages, dated Jun. 21, 2021.
Japanese Patent Application No. 2017-200714, Notice of Reasons for Refusal, 8 pages, dated Jun. 14, 2021.
Japanese Patent Application No. 2017-200045, Notice of Reasons for Refusal, 5 pages, dated Jun. 25, 2021.

* cited by examiner

TURBOMACHINE BLADE TRAILING EDGE COOLING CIRCUIT WITH TURN PASSAGE HAVING SET OF OBSTRUCTIONS

STATEMENT REGARDING FEDERALLY SPONSORED RESEARCH

This invention was made with government support under Grant No. DE-FE0031616 awarded by the Department of Energy. The government has certain rights in the invention.

TECHNICAL FIELD

The disclosure relates generally to turbomachine blades and, more particularly, to a turbomachine blade having a trailing edge cooling circuit with a turn passage having a set of obstructions therein.

BACKGROUND

Turbomachine blades, such as rotor blades or stationary vanes, include airfoils that accelerate flow through contraction of area and the introduction of tangential velocity. The trailing edges of the airfoils are difficult to cool due to the small volume of material compared to the large heat loads at that location. Notably, the mismatch between external surface area and the internal surface makes any cooling solution challenging. To address this situation, trailing edges are typically cooled with coolant flows having high flow rates. The high flow rates to the trailing edges decreases the coolant that can be used elsewhere. The high flow rates also require the trailing edges to have minimum thicknesses to accommodate the passages that deliver the coolant flow and create the necessary cold-to-hot area ratio. The minimum thicknesses do not allow for sharper trailing edges that would improve aerodynamic performance.

BRIEF DESCRIPTION

All aspects, examples and features mentioned below can be combined in any technically possible way.

An aspect of the disclosure provides a turbomachine blade, comprising: an airfoil body having a pressure side and a suction side connected by a leading edge and a trailing edge; a coolant feed passage defined in the airfoil body; a first coolant reuse passage defined in the airfoil body; a first cooling circuit defined in the airfoil body, the first cooling circuit including: a first rearward passage extending toward the trailing edge from and fluidly coupled to the coolant feed passage; a first radially spreading return passage extending away from the trailing edge toward and fluidly coupled to the first coolant reuse passage; and a first radially extending turn passage coupling the first rearward passage and the first radially spreading return passage; and a first set of obstructions positioned in the first radially extending turn passage.

Another aspect of the disclosure includes any of the preceding aspects, and further comprises a plurality of vent passages extending from the first radially extending turn passage through the trailing edge of the airfoil body.

Another aspect of the disclosure includes any of the preceding aspects, and the first rearward passage is radially offset from the first radially spreading return passage along a radial axis of the airfoil body.

Another aspect of the disclosure includes any of the preceding aspects, and further comprises a second set of obstructions positioned in the first radially spreading return passage.

Another aspect of the disclosure includes any of the preceding aspects, and further comprises: a second cooling circuit defined in the airfoil body, the second cooling circuit including: a second rearward passage extending toward the trailing edge from and fluidly coupled to the coolant feed passage; a second radially spreading return passage extending away from the trailing edge toward and fluidly coupled to a second coolant reuse passage defined in the airfoil body; and a second radially extending turn passage coupling the second rearward passage and the second radially spreading return passage; wherein the second rearward passage is radially offset from the second radially spreading return passage along the radial axis of the airfoil body.

Another aspect of the disclosure includes any of the preceding aspects, and the first cooling circuit is circumferentially offset from the second cooling circuit in the airfoil body.

Another aspect of the disclosure includes any of the preceding aspects, and further comprises a second set of obstructions positioned in the second radially spreading return passage.

Another aspect of the disclosure includes any of the preceding aspects, and further comprises a plurality of the first cooling circuits radially spaced in the airfoil body, and a plurality of second cooling circuits radially spaced in the airfoil body.

Another aspect of the disclosure includes any of the preceding aspects, and the trailing edge has an ellipse ratio between 1.1 and 4.

Another aspect of the disclosure includes any of the preceding aspects, and the first cooling circuit is adjacent the suction side of the airfoil body, and the second cooling circuit is adjacent the pressure side of the airfoil body.

Another aspect of the disclosure includes any of the preceding aspects, and the first radially extending turn passage has a first circumferential width at a forward end thereof that is greater than a second circumferential width at an aft end thereof.

An aspect of the disclosure provides a coupon for replacing a cutout of a predetermined area in an airfoil body of a turbomachine blade, the airfoil body having a pressure side and a suction side connected by a leading edge and a trailing edge, the cutout within the trailing edge of the airfoil body, the coupon comprising: a coupon body; a first cooling circuit defined in the coupon body, the first cooling circuit including: a first rearward passage extending toward the trailing edge from and fluidly coupled to a coolant feed passage defined in at least one of the coupon body and the airfoil body; a first radially spreading return passage extending away from the trailing edge toward and fluidly coupled to a first coolant reuse passage defined in at least one of the coupon body and the airfoil body; a first radially extending turn passage coupling the first rearward passage and the first radially spreading return passage; and a first set of obstructions positioned in the first radially extending turn passage.

Another aspect of the disclosure includes any of the preceding aspects, and further comprises a plurality of vent passages extending from the first radially extending turn passage through the trailing edge of the coupon body.

Another aspect of the disclosure includes any of the preceding aspects, and the first rearward passage is radially offset from the first radially spreading return passage along a radial axis of the airfoil body.

Another aspect of the disclosure includes any of the preceding aspects, and further comprises a second set of obstructions positioned in the first radially spreading return passage.

Another aspect of the disclosure includes any of the preceding aspects, and further comprises: a second cooling circuit defined in the coupon body, the second cooling circuit including: a second rearward passage extending toward the trailing edge from and fluidly coupled to the coolant feed passage; a second radially spreading return passage extending away from the trailing edge toward and fluidly coupled to a second coolant reuse passage defined in at least one of the coupon body and the airfoil body; and a second radially extending turn passage coupling the second rearward passage and the second radially spreading return passage, wherein the second rearward passage is radially offset from the second radially spreading return passage along the radial axis of the airfoil body.

Another aspect of the disclosure includes any of the preceding aspects, and the trailing edge has an ellipse ratio between 1.1 and 4.

Another aspect of the disclosure includes any of the preceding aspects, and the first radially extending turn passage has a first circumferential width at a forward end thereof that is greater than a second circumferential width at an aft end thereof.

An aspect of the disclosure provides a gas turbine system, comprising: a compressor; a combustor; and a turbine, the turbine including a turbomachine blade including a trailing edge cooling system, the turbomachine blade including: an airfoil body having a pressure side and a suction side connected by a leading edge and a trailing edge; a coolant feed passage defined in the airfoil body; a first coolant reuse passage defined in the airfoil body; a first cooling circuit defined in the airfoil body, the first cooling circuit including: a first rearward passage extending toward the trailing edge from and fluidly coupled to the coolant feed passage; a first radially spreading return passage extending away from the trailing edge toward and fluidly coupled to the first coolant reuse passage; and a first radially extending turn passage coupling the first rearward passage and the first radially spreading return passage; and a first set of obstructions positioned in the first radially extending turn passage.

Two or more aspects described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
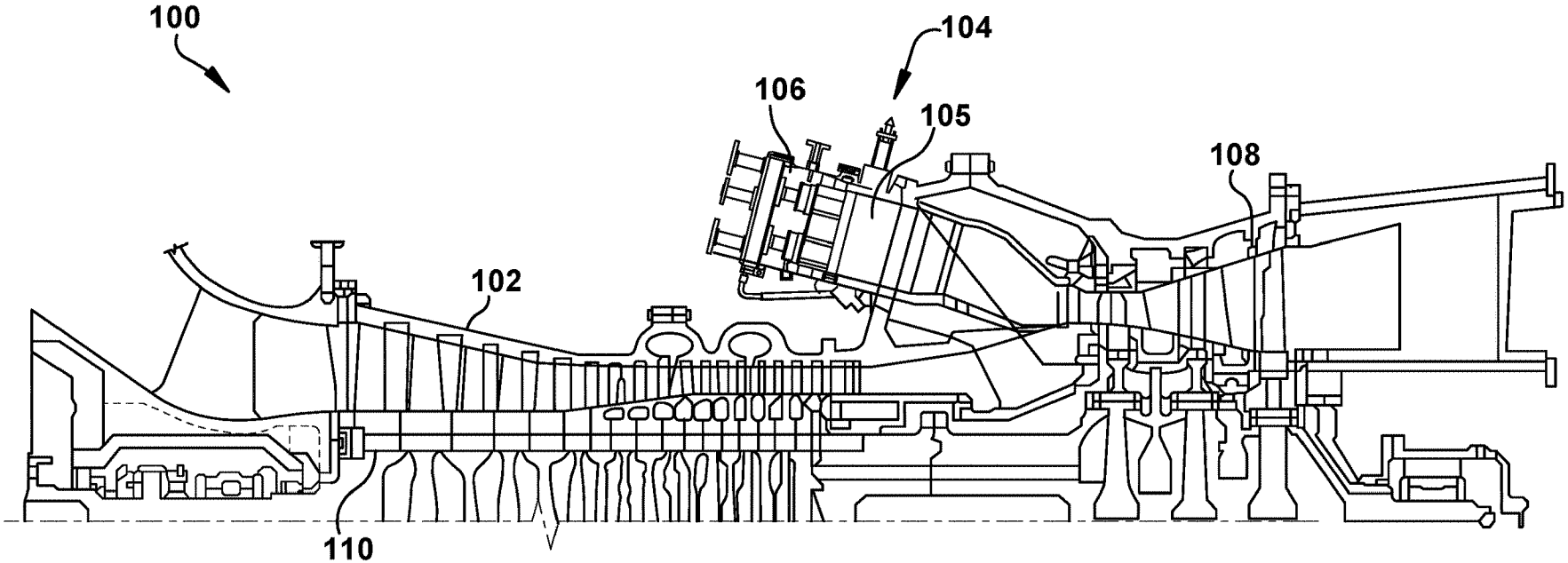
FIG. 1 (Prior Art)
FIG. 1 shows a schematic cross-sectional view of an illustrative turbomachine in the form of a gas turbine system.

It is noted that the drawings of the disclosure are not necessarily to scale. The drawings are intended to depict only typical aspects of the disclosure and therefore should not be considered as limiting the scope of the disclosure. In the drawings, like numbering represents like elements among the drawings.

DETAILED DESCRIPTION

As an initial matter, in order to clearly describe the subject matter of the current disclosure, it will become necessary to select certain terminology when referring to and describing relevant machine components within a turbomachine and/or a turbomachine blade. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow (i.e., the direction from which the flow originates). The terms "forward" and "aft," without any further specificity, refer to directions, with "forward" referring to the front or compressor end of the engine, and "aft" referring to the rearward section of the turbomachine. In context herein, "forward" refers to the leading edge of a turbomachine blade, and "aft" or "rear" refers to the trailing edge of a turbomachine blade.

It is often required to describe parts that are disposed at differing radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to the axis of rotation of the turbine system, or in a chordal direction between leading and trailing edges of an airfoil. Finally, the term "circumferential" refers to movement or position around an axis. It will be appreciated that such terms may be applied in relation to the center axis of the turbine. In the figures (see, e.g., the legend in FIG. 3), an axial orientation is referenced with an "A"; a radial orientation is referenced with an "R"; and a circumferential orientation (about axis A) is referenced with a "C".

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises," "comprising," "including," and/or "having," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently described component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a turbomachine blade and a coupon for a turbomachine blade. The turbomachine blade may include an airfoil body having a pressure side and a suction side connected by a leading edge and a trailing edge, a coolant feed passage defined in the airfoil body, and a coolant reuse (collection) passage defined in the airfoil body. The blade may also include a first cooling circuit defined in the airfoil body. The first cooling circuit may include a rearward passage extending toward the trailing edge from and fluidly coupled to the coolant feed passage, and a radially spreading return passage extending away from the trailing edge toward and fluidly coupled to the coolant reuse passage. The first cooling circuit may also include a radially extending turn passage coupling the rearward passage and the radially spreading return passage. A first set of obstructions may be positioned in the radially extending turn passage.

The obstructions, created through additive manufacturing, have a density that allows a lower coolant flow rate and creates sufficient back pressure to allow some of the coolant to exit through vent openings in the trailing edge. The obstructions in the turn passage also provide additional structural strength and allow the trailing edge to have a sharper turn and use thinner walls, thus improving aerodynamic performance of the blade. Coolant not exiting through the vent openings can be reused, for example, for film cooling an exterior surface of the airfoil body or for other purposes.

A second cooling circuit may also be provided, e.g., on a pressure side of the airfoil body, to shield parts of the first cooling circuit from a heat load, thus improving the effectiveness of coolant in the first cooling circuit.

FIG. 1 shows a schematic illustration of an illustrative turbomachine 100 in the form of a combustion or gas turbine system. Turbomachine 100 includes a compressor 102 and a combustor 104. Combustor 104 includes a combustion region 105 and a fuel nozzle assembly 106. Turbomachine 100 also includes a turbine 108 and a common compressor/turbine shaft 110 (sometimes referred to as rotor 110). In one embodiment, the combustion turbine system is a 7 HA or 9 HA engine, commercially available from General Electric Company, Greenville, S.C. The present disclosure is not limited to any one particular GT system and may be implemented in connection with other engines including, for example, the other HA, F, B, LM, GT, TM and E-class engine models of General Electric Company and engine models of other companies. Further, the teachings of the disclosure are not necessarily applicable to only a GT system and may be applied to other types of turbomachines, e.g., steam turbines, jet engines, compressors, etc.

In operation, air flows through compressor 102, and compressed air is supplied to combustor 104. Specifically, the compressed air is supplied to fuel nozzle assembly 106 that is integral to combustor 104. Assembly 106 is in flow communication with combustion region 105. Fuel nozzle assembly 106 is also in flow communication with a fuel source (not shown in FIG. 1) and channels fuel and air to combustion region 105. Combustor 104 ignites and combusts fuel. Combustor 104 is in flow communication with turbine 108 within which gas stream thermal energy is converted to mechanical rotational energy. Turbine 108 is rotatably coupled to and drives rotor 110. Compressor 102 also is rotatably coupled to rotor 110. In the illustrative embodiment, there are a plurality of combustors 104 and fuel nozzle assemblies 106.

Figure 2:
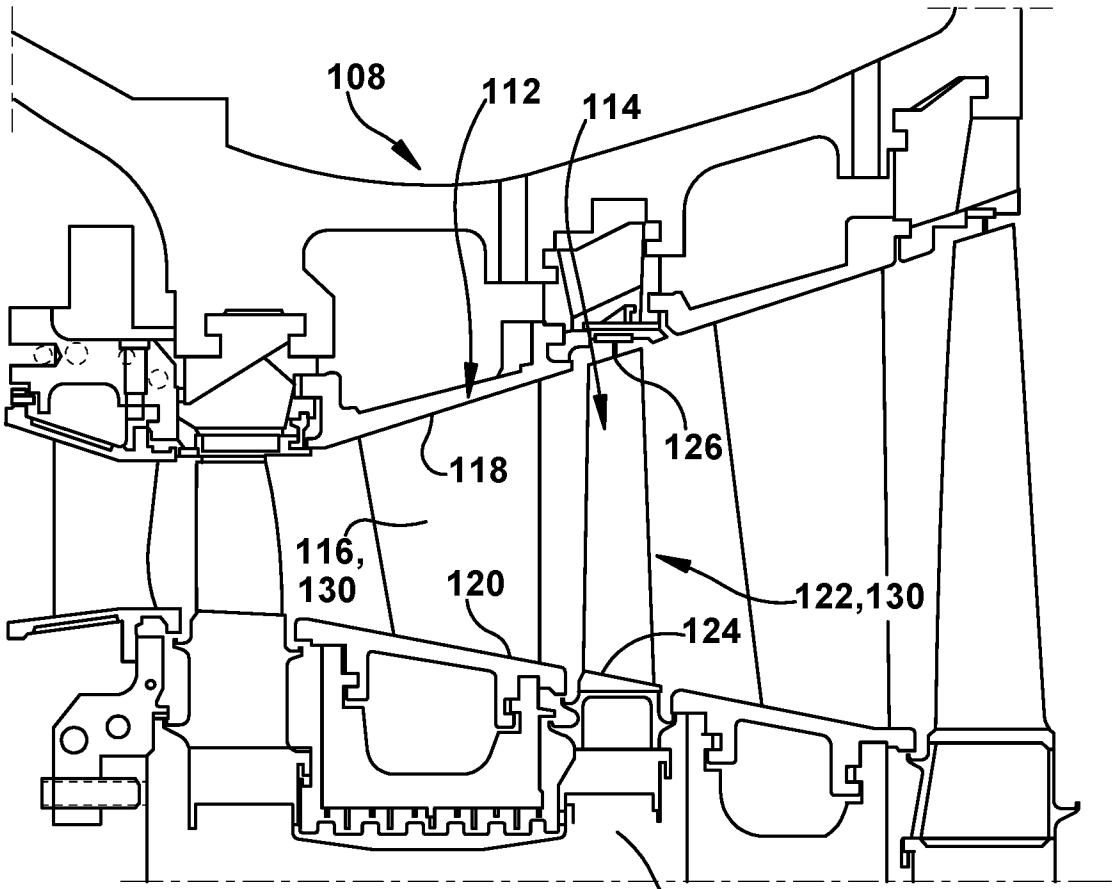
FIG. 2 (Prior Art)
FIG. 2 shows a cross-sectional view of an illustrative gas turbine assembly with a three-stage turbine that may be used with the gas turbine system in FIG. 1.

FIG. 2 shows a cross-sectional view of an illustrative turbine 108 of turbomachine 100 (FIG. 2) with three turbine stages that may be used with the gas turbine system in FIG. 2. Each turbine stage of turbine 108 includes a row of stationary blades 112 coupled to a stationary casing of turbomachine 100 and positioned axially adjacent a rotating row of blades 114. Row of blades 112 includes stationary blades or nozzles 116 (vanes). Each nozzle 116 may be held in turbine assembly 108 by a radially outer platform 118 and a radially inner platform 120. Row of rotating blades 114 in turbine 108 includes rotating blades 122 coupled to rotor 110 and rotating with the rotor 110. Rotating blades 122 include a radially inward platform 124 (at root of blade) coupled to rotor 110 and, optionally, may include a radially outward tip shroud 126 (at tip of blade). As used herein, the term "blade" shall refer collectively to stationary blades for vanes or nozzles 116 and rotating blades 122, unless otherwise stated.

Figure 3:
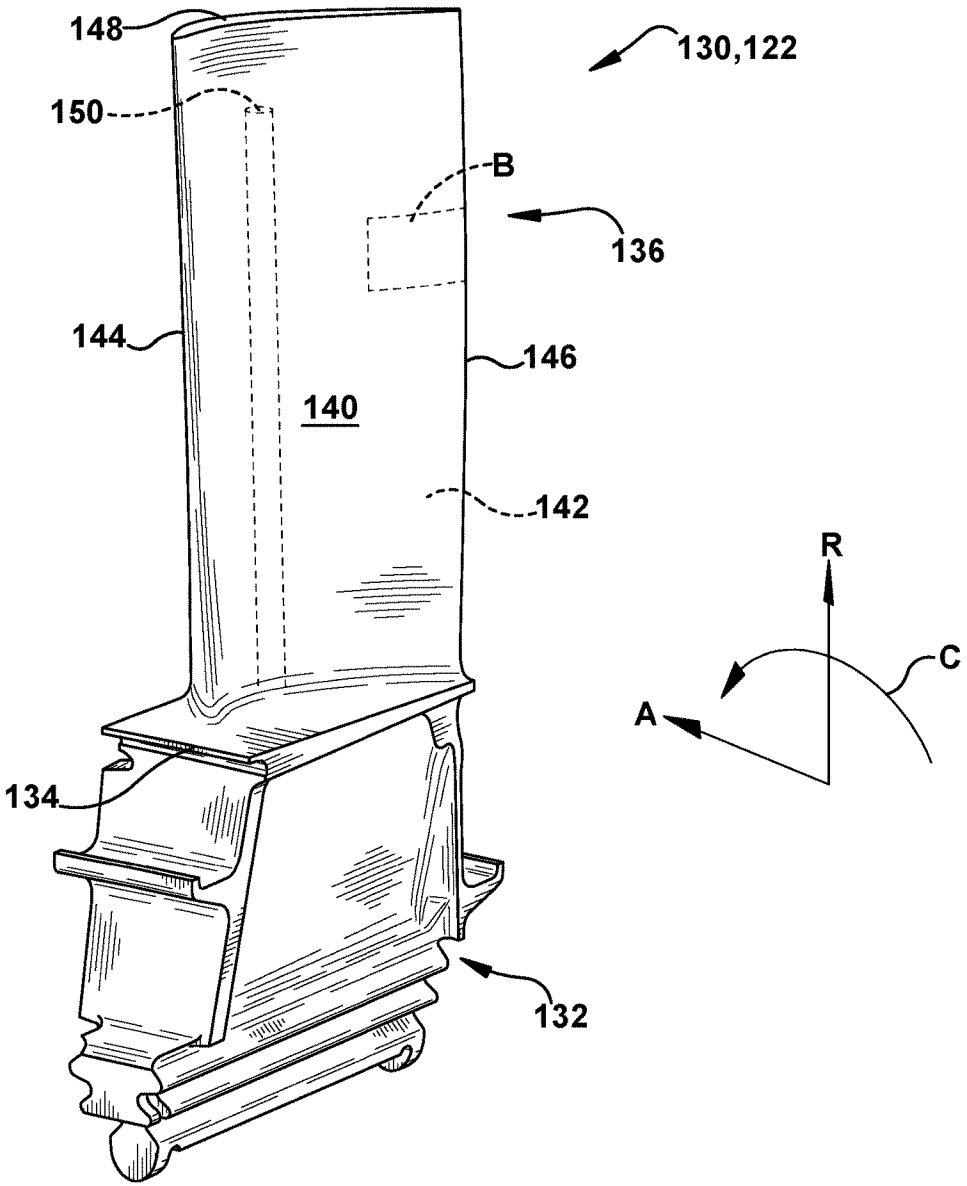
FIG. 3 shows a perspective view of an illustrative turbomachine blade in the form of a turbine rotor blade of the type in which embodiments of the disclosure may be employed.

FIG. 3 is a perspective view of a blade 130 in the form of a turbine rotor blade 122 of the type in which embodiments of the present disclosure may be employed. Blade 130 includes a root 132 by which blade 130 attaches to rotor 110 (FIG. 2). Root 132 may include a dovetail configured for mounting in a corresponding dovetail slot in the perimeter of the rotor disc. Root 132 may further include a shank that extends between the dovetail and a platform 134, which is disposed at the junction of an airfoil body 136 and root 132 and defines a portion of the inboard boundary of the flow path through turbine 108. It will be appreciated that airfoil body 136 is the active component of rotor blade 130 that intercepts the flow of working fluid and induces the rotor disc to rotate.

Airfoil body 136 of blade 130 includes a pressure side 140, i.e., a concave pressure side (PS) outer wall, and a circumferentially or laterally opposite suction side 142, i.e., a convex suction side (SS) outer wall, extending axially between opposite leading and trailing edges 144, 146 respectively. Pressure side 140 and suction side 142 are connected by leading edge 144 and trailing edge 146 and also extend in the radial direction from platform 134 to an outboard tip 148. Outboard tip 148 is shown without a tip shroud (e.g., tip shroud 126 in FIG. 2). A radially extending coolant feed/reuse circuit 150 may extend between walls 140, 142. While blade 130 of this example is a turbine rotor blade 122 (FIGS. 2-3), it will be appreciated that the present disclosure also may be applied to other types of blades within turbine engine 100, including turbine nozzles 116 (FIGS. 2 and 17) (vanes). The usage of rotor blades in the several embodiments described herein is merely illustrative unless otherwise stated.

Figure 4:
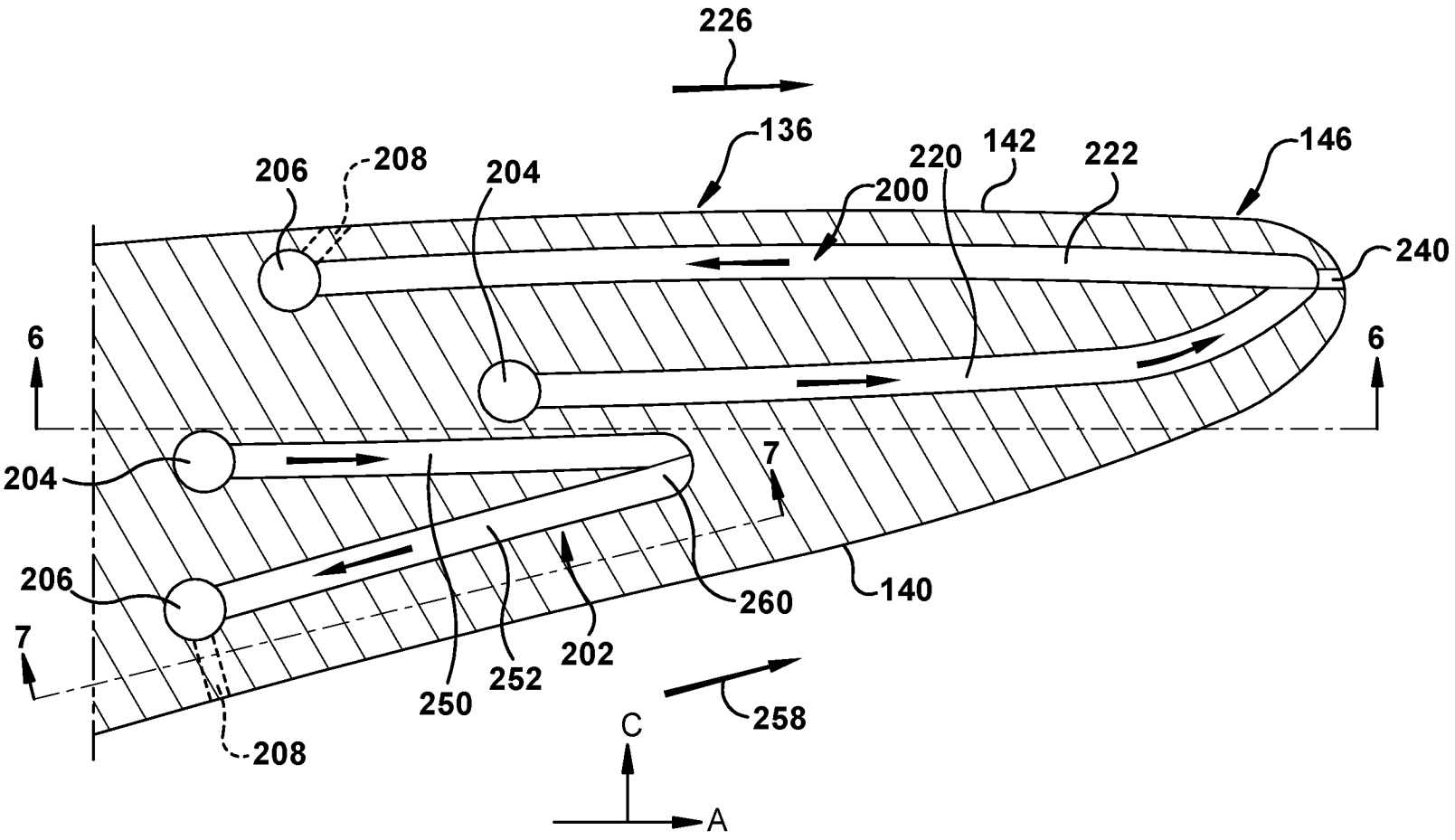
FIG. 4 shows a schematic top-down view of cooling circuit(s) in a trailing edge of an airfoil body such as of the turbine rotor blade of FIG. 3, according to embodiments of the disclosure.
Figure 5:
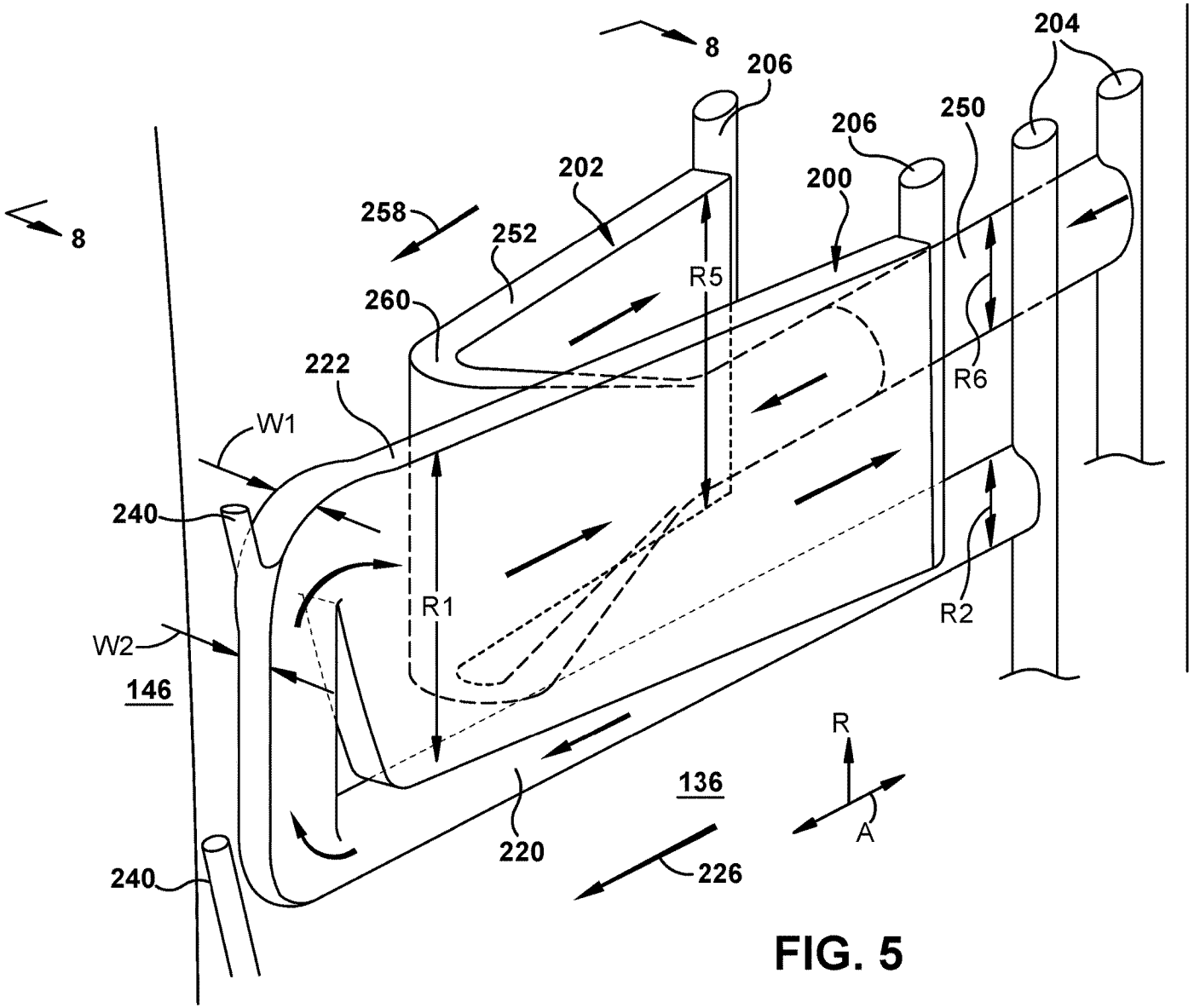
FIG. 5 shows a schematic perspective view of cooling circuits of FIG. 4 apart from an airfoil body, according to embodiments of the disclosure.
Figure 7:
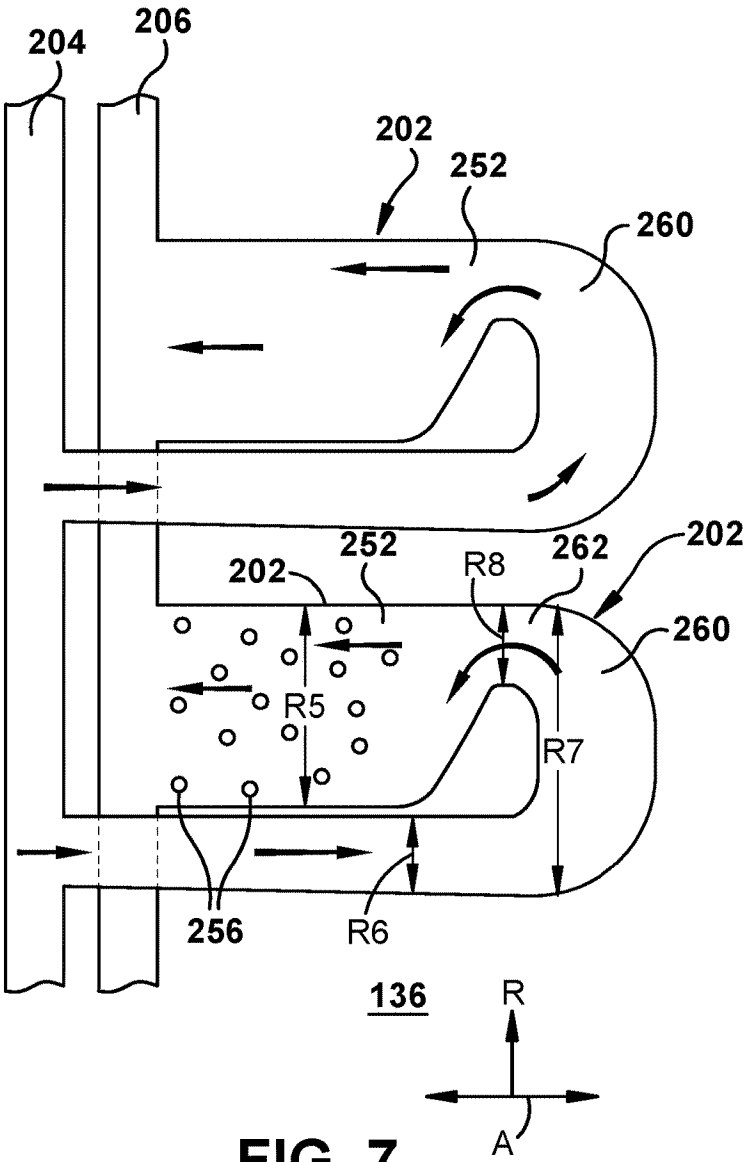
FIG. 7 shows a schematic side view of a plurality of second cooling circuits, taken along view line 7-7 in FIG. 4.
Figure 6:
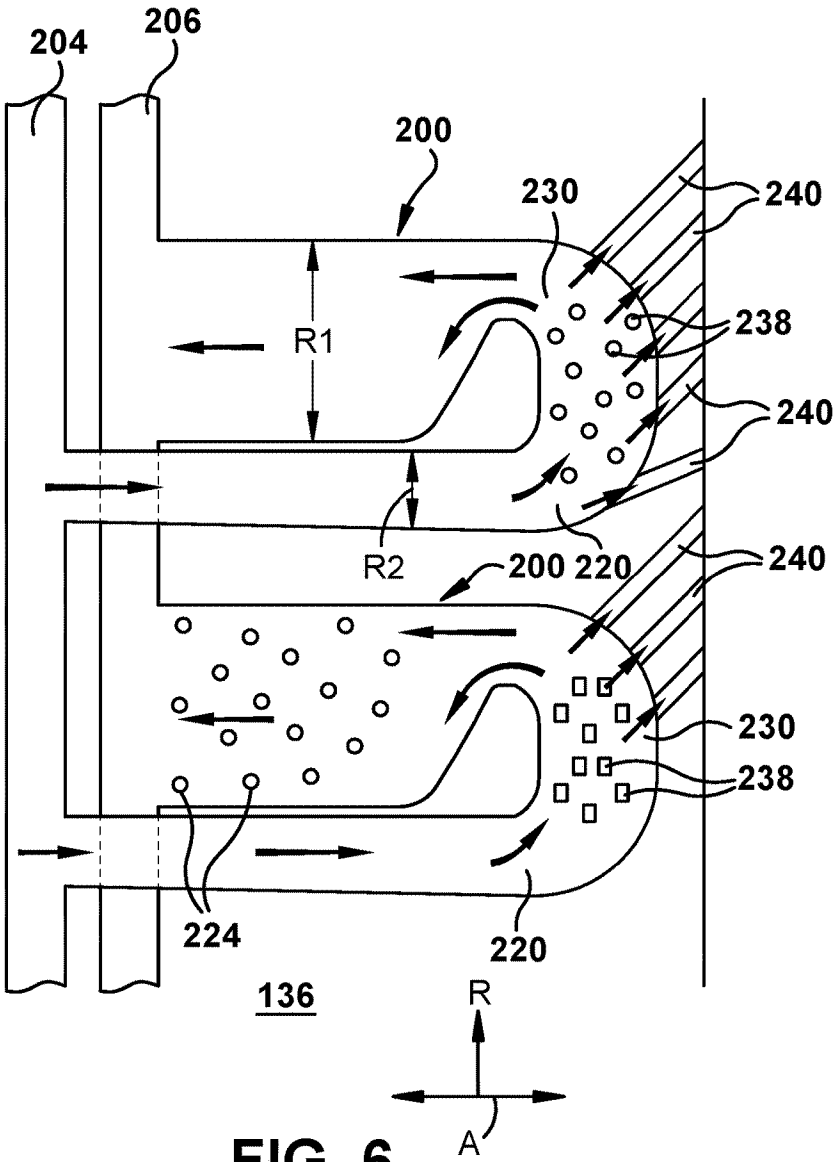
FIG. 6 shows a schematic side view of a plurality of first cooling circuits, taken along view line 6-6 in FIG. 4.
Figure 8:
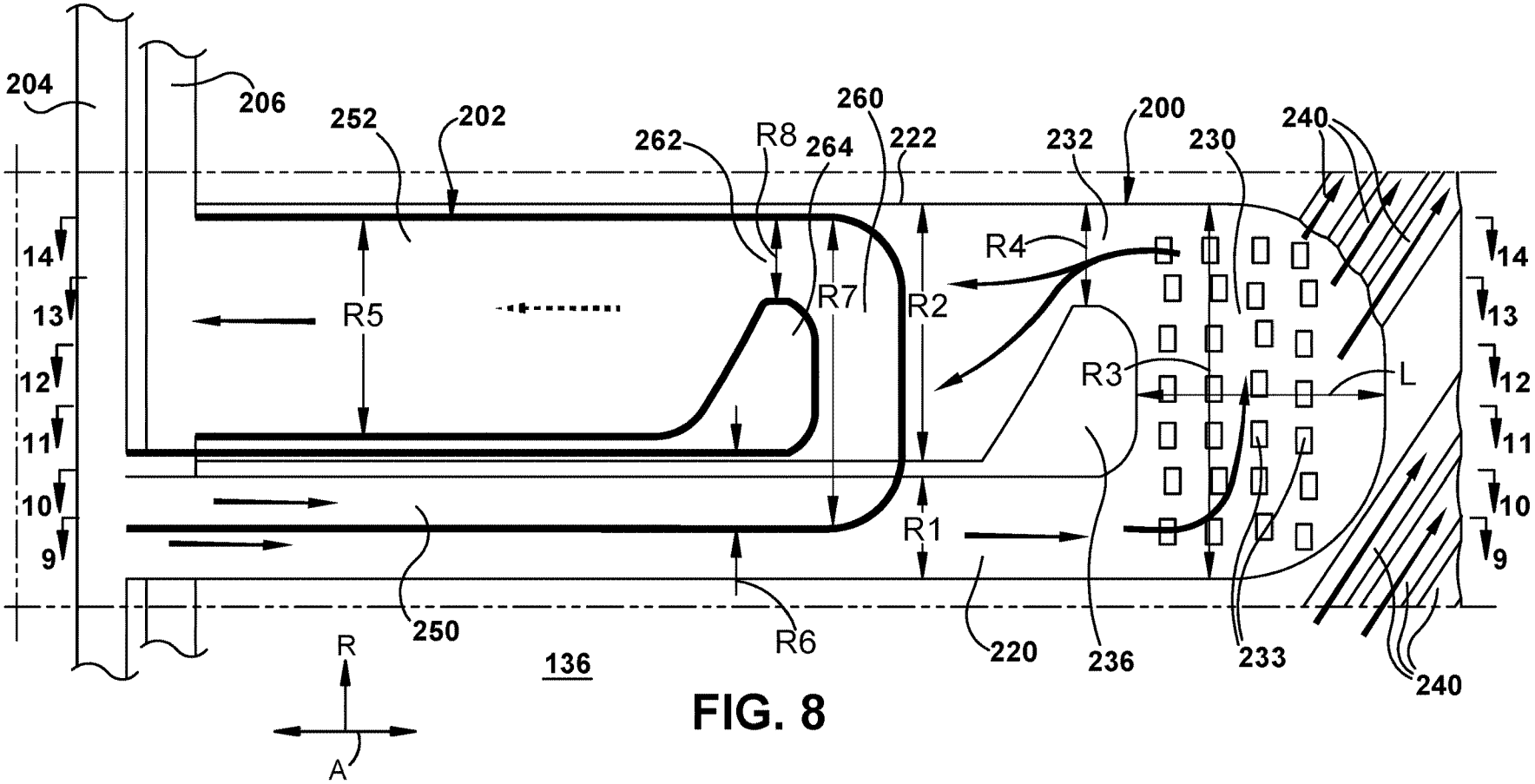
FIG. 8 shows a schematic side view of a first cooling circuit and a second cooling circuit, as in FIGS. 6 and 7, overlaid together.
Figure 9:
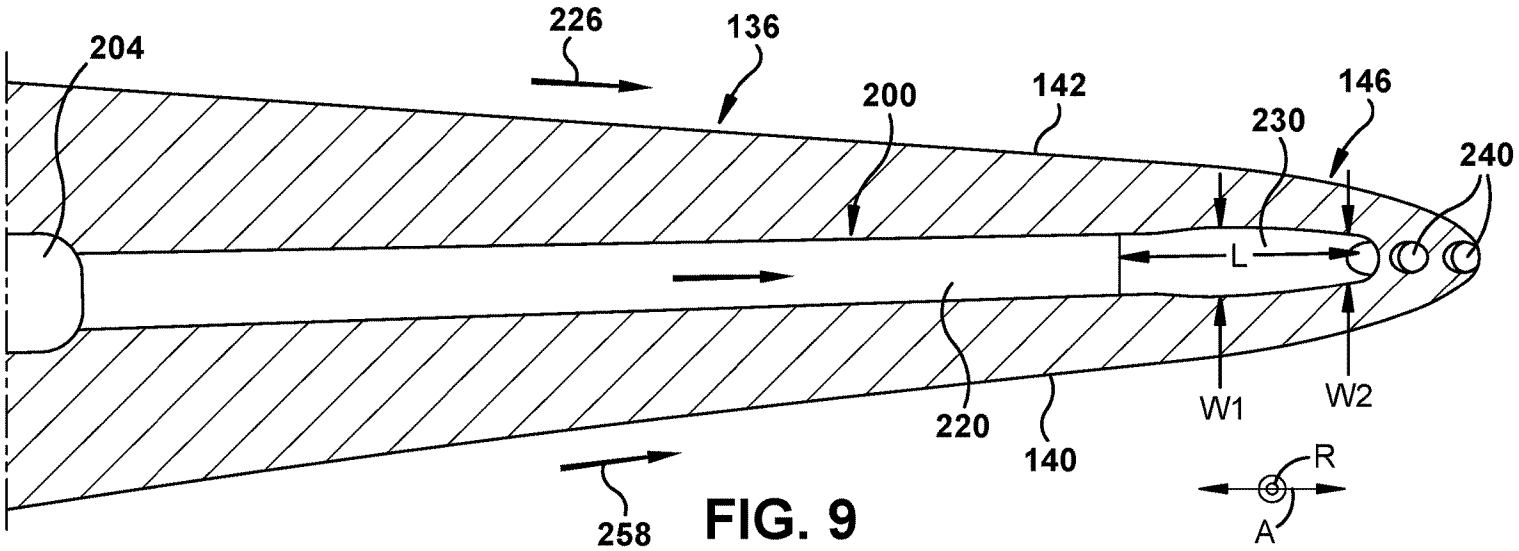
FIG. 9 shows a top-down cross-sectional view of the cooling circuits across view line 9-9 in FIG. 8.
Figure 10:
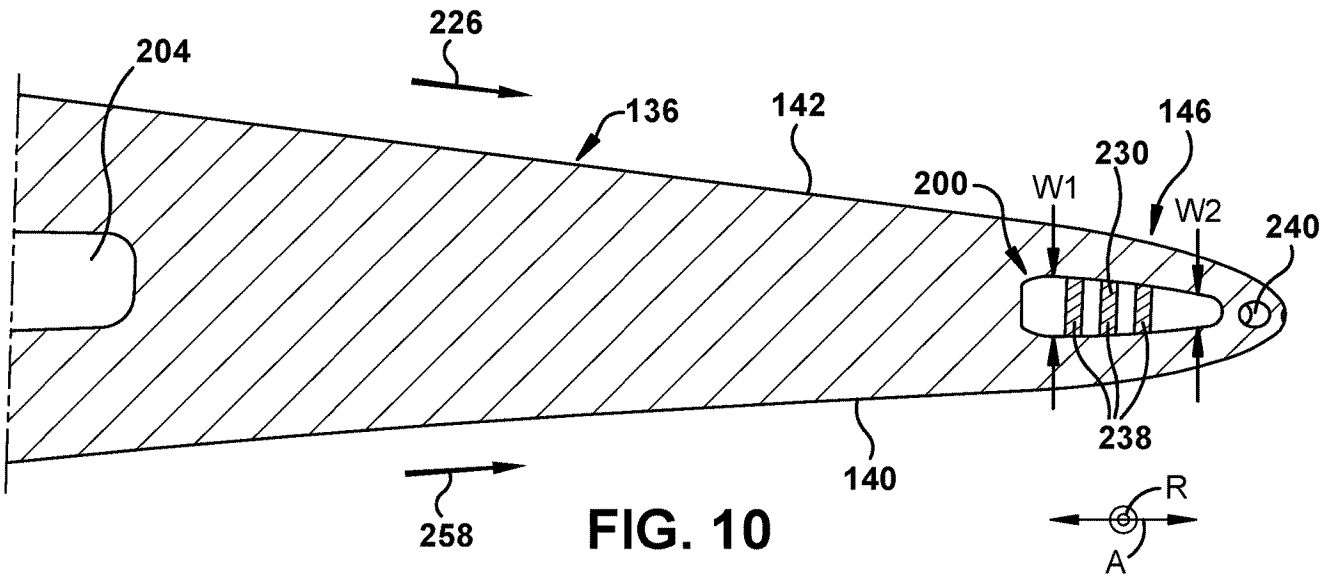
FIG. 10 shows a top-down cross-sectional view of the cooling circuits across view line 10-10 in FIG. 8.
Figure 11:
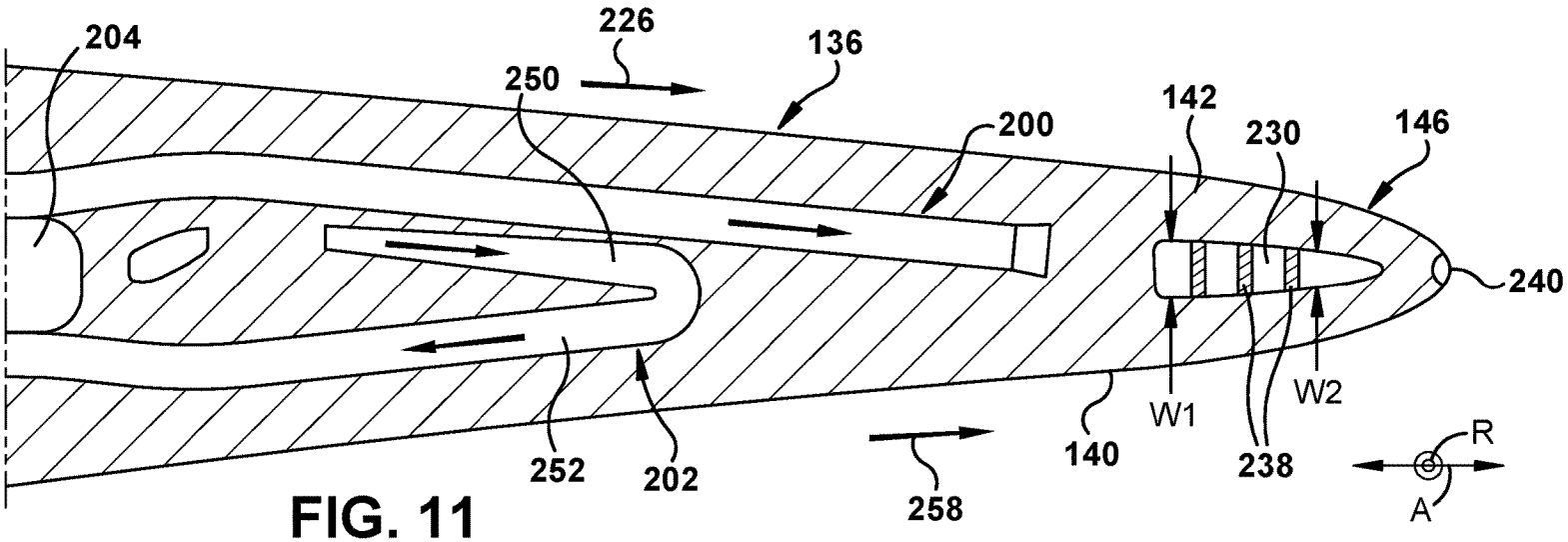
FIG. 11 shows a top-down cross-sectional view of the cooling circuits across view line 11-11 in FIG. 8.
Figure 12:
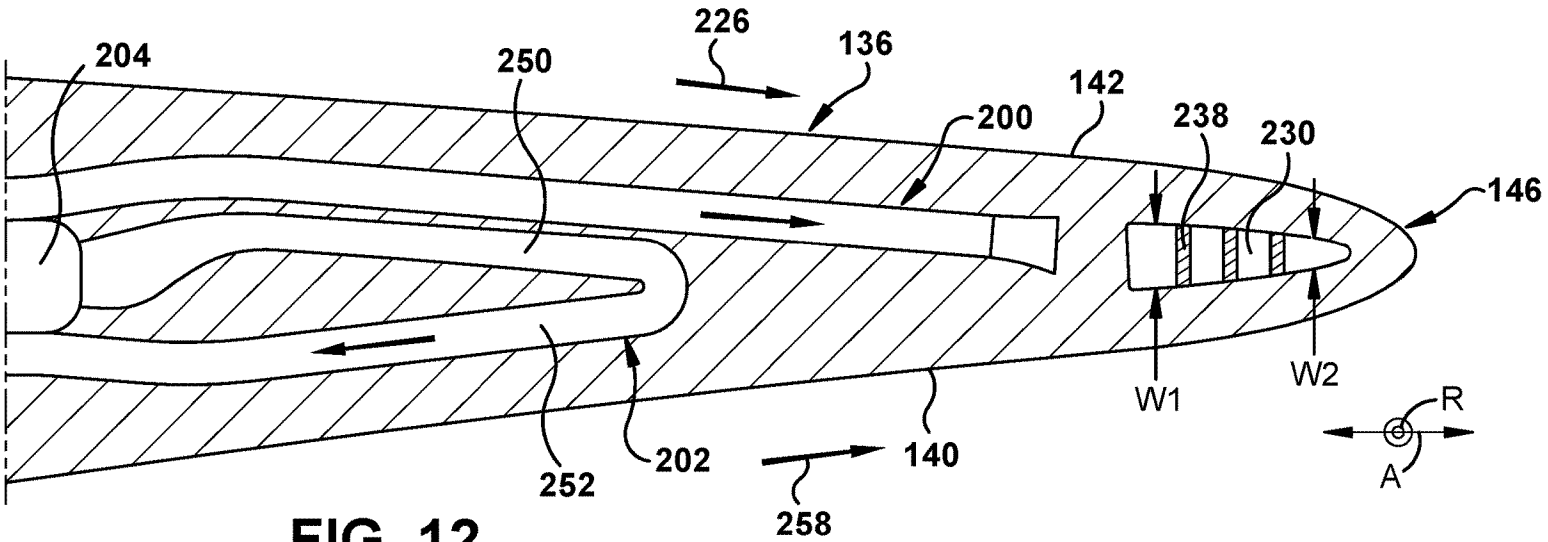
FIG. 12 shows a top-down cross-sectional view of the cooling circuits across view line 12-12 in FIG. 8.
Figure 13:
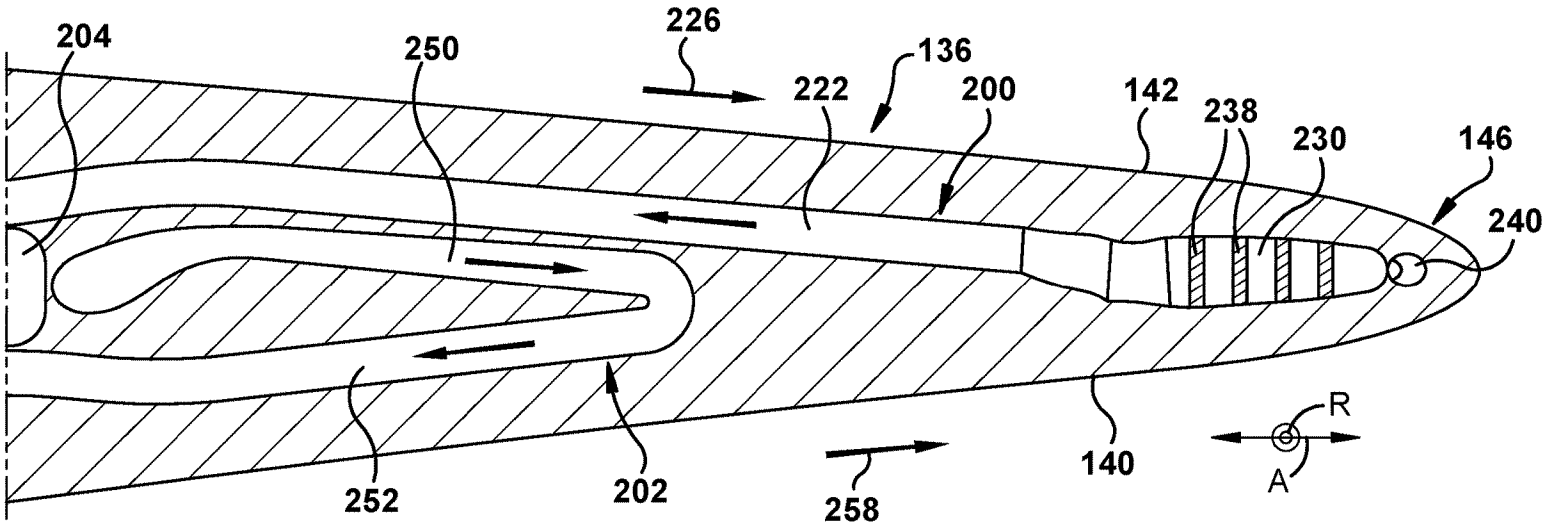
FIG. 13 shows a top-down cross-sectional view of the cooling circuits across view line 13-13 in FIG. 8.
Figure 14:
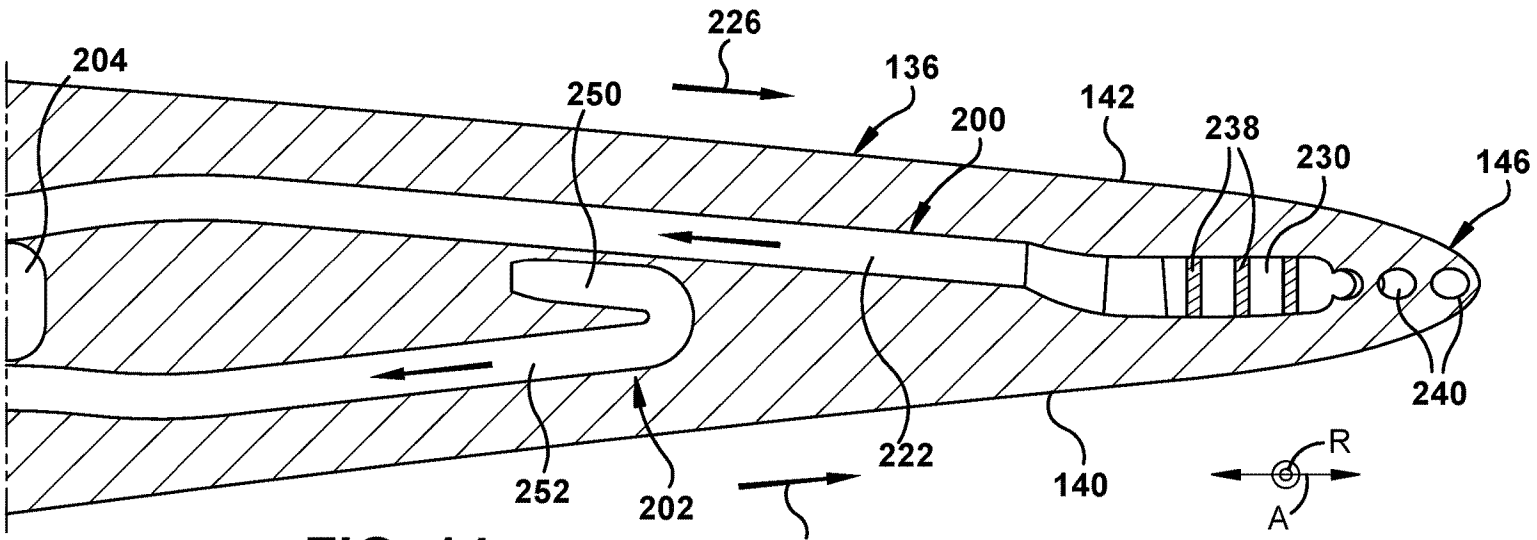
FIG. 14 shows a top-down cross-sectional view of the cooling circuits across view line 14-14 in FIG. 8.

FIGS. 4-14 show various views of cooling circuit(s) defined in airfoil body 136 and, in particular, in trailing edge 146, according to embodiments of the disclosure. FIG. 4 shows a schematic top-down view an embodiment of a first cooling circuit 200 and an optional second cooling circuit 202. FIGS. 5-7 show the portion of cooling circuits 200 and/or 202 in trailing edge 146 within a non-limiting position in blade 130 (designated as position "B" in FIG. 3). More particularly, FIG. 5 shows a schematic perspective view of cooling circuits 200, 202 apart from airfoil body 136 (FIG. 4); FIG. 6 shows a schematic side view of an embodiment of a plurality of first cooling circuits 200 along view line 6-6 in FIG. 4; and FIG. 7 shows a schematic side view of a plurality of second cooling circuits 202 along view line 7-7 in FIG. 4. FIG. 8 shows a schematic side view of first cooling circuit 200 and second cooling circuit 202 overlaid together; and FIGS. 9-14 show top-down cross-sectional views across view lines 9-9, 10-10, 11-11, 12-12, 13-13 and 14-14 in FIG. 8, respectively.

Blade 130 (FIG. 3) may include one or more coolant feed passages 204 defined in airfoil body 136 for delivering a coolant to cooling circuit(s) 200, 202. Coolant feed passage (s) 204 may include any, typically radially extending, passage configured to deliver coolant for use in cooling, for example, trailing edge 146. Coolant can be any now known or later developed coolant used in a turbomachine blade such as, but not limited to, compressed air from compressor 102, which may be delivered to coolant feed passage(s) 204 through various plenums or casings of the turbomachine and/or blades thereof. Coolant feed passages 204 may be part of a coolant feed/reuse circuit 150 (FIG. 3).

Blade 130 (FIG. 3) may also include one or more a coolant reuse passages 206 defined in airfoil body 136 for collecting coolant from cooling circuit(s) 200, 202 for reuse in cooling other parts of the blade. Coolant reuse passage(s) 206 may include any typically radially extending passage configured to collect coolant from cooling circuit(s) 200, 202. Coolant reuse passage(s) 206 may route used coolant to other parts of airfoil body 136 or parts of blade 130, e.g., tip, tip shroud, etc., or it may route used coolant to exterior surfaces of airfoil body 136, e.g., for film cooling. In the latter case, as shown in FIG. 4, coolant reuse passage(s) 206 may include vent openings 208 to pressure side 140 and/or suction side 142.

In some of the drawings, two coolant feed passages 204 are shown, one for first cooling circuit 200 and one for second cooling circuit 202. Other drawings, such as FIG. 8, show a shared coolant feed passage 204 and a shared coolant reuse passage 206. It is emphasized that any number of coolant feed or reuse passages 204, 206 can be employed.

Figure 16:
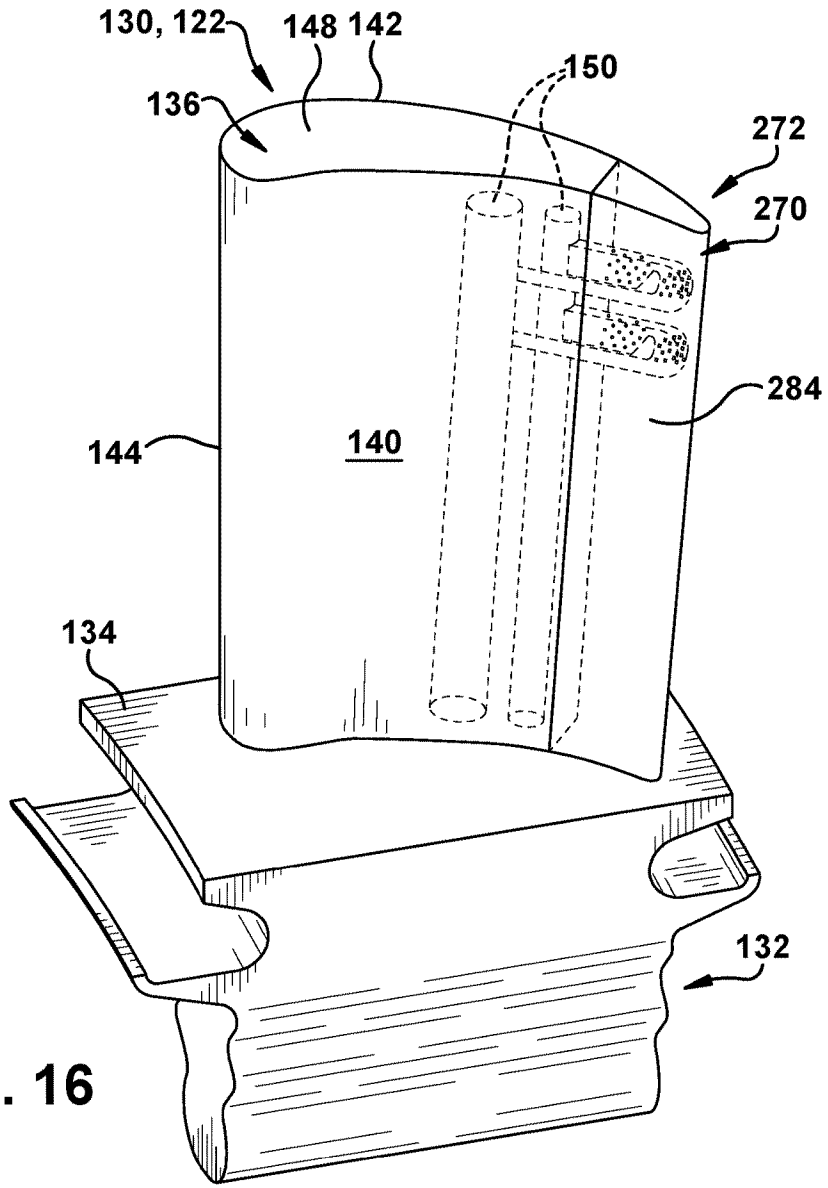
FIG. 16 shows a perspective view of a blade including the coupon including cooling circuit(s), according to embodiments of the disclosure.

First cooling circuit 200 is defined in airfoil body 136 or, as will be described, in a coupon body 270 (FIG. 16). In the example shown, first cooling circuit 200 is adjacent suction side 142 of airfoil body 136, which is cooler than pressure side 140 of airfoil body 136 during operation in a turbomachine. First cooling circuit 200 may include a first rearward (feed or inlet) passage 220 extending toward trailing edge 146 from and fluidly coupled to coolant feed passage 204. First rearward passage 220, which extends generally axially, can have any tubular cross-sectional shape, e.g., circular. First cooling circuit 200 also includes a first radially spreading return passage 222 extending away from trailing edge 146 toward and fluidly coupled to first coolant reuse passage 206. As shown best in FIGS. 5, 6 and 8, radially spreading return passage 222 has a radial extent R1 that is significantly greater than a radial extent R2 of rearward passage 220, e.g., greater than 3 times.

As shown in the lower return passage in FIG. 6, a set of obstructions 224, such as a pin or fin bank, may be optionally positioned in first radially spreading return passage 222 to increase cooling, improve structural integrity, and/or control back pressure.

As shown best in FIGS. 4 and 5, return passage 222 may be partially or completely between rearward passage 220 and a hot gas path (HGP) 226 about suction side 142 of airfoil body 136, which limits the amount of energy picked up by coolant before entering trailing edge 146. In this manner, most of the coolant's energy is used in trailing edge 146 rather than prior to trailing edge 146. Coolant returning in return passage 222 may be reused in any manner, e.g., film cooling for suction side 142 and/or pressure side 140. As shown in FIGS. 5, 6 and 8, first rearward passage 220 is radially offset from first radially spreading return passage 222 along a radial axis R of airfoil body 136.

As shown in FIGS. 4, 5, 6, 8-14, first cooling circuit 200 also may include a first radially extending turn passage 230 (hereafter "turn passage 230") coupling first rearward passage 220 and first radially spreading return passage 222. Turn passage 230 may extend any radial extent R3 (FIG. 8) necessary to fluidly couple rearward passage 220 and return passage 222. As shown for example in FIGS. 5 and 9-12, turn passage 230 may have a first circumferential width W1 at a forward end thereof that is greater than a second circumferential width W2 at an aft end thereof. The elliptical shape near the aft end (closest to trailing edge 146) has a length-to-width (L/W2)(see e.g., FIG. 9) ratio of between 1:1 and 4:1, inclusive of end values. In this manner, coolant passes as close as possible to trailing edge 146 in turn passage 230, and a shape of trailing edge 146 can be more narrow and/or pointed compared to previous blades to improve aero-performance.

As illustrated for example in FIG. 8, return passage 222 may fluidly couple to turn passage 230 via a coupling passage 232 that is radially smaller (R4) than return passage 222 (R2), i.e., it has a smaller cross-sectional area. A coolant flow (dark arrows) may travel axially rearwardly through rearward passage 220 from feed passage 204, radially outward in turn passage 230 and then axially forward starting in coupling passage 232 and may then expand radially as it flows axially forward in return passage 220 to reuse passage 206. Coolant flows radially outward in turn passage 230 and over a separating wall 236 between turn passage 230 and return passage 222.

Referring to FIGS. 6 and 8, a first set of obstructions 238 may be positioned in turn passage 230. Obstructions 238 can take the form of any structure typically used to improve structural integrity of a passage, create back pressure and/or improve heat transfer of a coolant flowing therethrough. In certain embodiments, as shown in the top turn passage 230 in FIG. 6, obstructions 238 may be cylindrical pins having a circular cross-section. In other embodiments, as shown in the bottom turn passage 230 in FIG. 6 and in FIG. 8, obstructions 238 may be polygonal pegs having polygonal cross-sections, e.g., rectangular, square, pentagonal, etc. The size and spacing of obstructions 238 that creates a specific density of obstructions can be selected to control, for example, heat transfer and back pressure in turn passage 230.

In particular, obstruction density may be increased to increase back pressure, which allows vent passages 240 (described herein) through trailing edge 146 to provide more direct exit of coolant, increases total flow rate though the cooling features, and increases cold side surface area for heat transfer. Hence, obstructions 238 enhance heat transfer and increase the surface area available to transfer energy to the coolant. Obstructions 238 also act as a metering area, allowing, for example, an increased number of vent passages 240 to be used on pressure side 140, increasing coolant film coverage. Obstructions 238 also add to the structural integrity of trailing edge 146.

In one non-limiting example, obstructions 238 were square and had side dimensions of 0.305-1.524 millimeters (0.012 to 0.060 inches) with spacing ranging from 1.07-1.73 times the side dimensions in a transverse-to-flow direction and 0.41-1.45 times the side dimensions in a flow direction (see arrows). In another non-limiting example, obstructions 238 had circular cross-sectional diameters of 0.305-1.067 (0.012-0.042 inches) with spacings ranging from 1.2-3 times the diameter in the transverse-to-flow direction and 1.1-1.7 times the diameter in the flow direction. In any event, the density of set of obstructions 238 can be selected to control, for example, structural strength and/or back pressure. The number, shapes and/or sizes of obstructions 238 in turn passages 230 (and other obstructions, described herein) may be the same throughout a given blade 130, or they may vary depending on, for example, radial location, turn passage size or shape, required heat transfer, required structural strength, number of vent passages 240 to be used, among other factors.

As shown in FIGS. 6, 8-11, 13 and 14, blade 130 may also include a plurality of vent passages 240 extending from radially extending turn passage 230 through trailing edge 146 of airfoil body 136. Coolant can vent through trailing edge 146 by way of vent passages 240. Any number of vent passages 240 may extend from turn passage 230 and may be at any angle/orientation, cross-sectional size or shape, and number, desired to create a particular coolant flow and/or to eliminate the need for any minimum trailing edge thickness based on manufacturing tolerances. Vent passages 240 may be angled toward pressure side 140 and/or suction side 142. Vent passages 240 provide a more direct exit for coolant flow, increasing the total flow rate through trailing edge 146 and also increasing the cold-side surface area for heat transfer.

Referring to FIGS. 4, 5, 7, 8 and 11-14, blade 130 may also optionally include second cooling circuit 202 defined in airfoil body 136. Second cooling circuit 202 is defined in airfoil body 136 or, as will be described, in coupon body 270 (FIG. 16). In the example shown, second cooling circuit 202 is adjacent pressure side 140 of airfoil body 136. Hence, second cooling circuit 202 provides cooling near pressure side 140 of airfoil body 136, which is hotter than suction side 142 of airfoil body 136 during operation of a turbomachine. As shown in FIGS. 4 and 5, first cooling circuit 200 is circumferentially offset from the second cooling circuit 202 in airfoil body 136. Hence, second cooling circuit 202 also acts as a buffer to protect coolant in first cooling circuit 200 from excessive heat transfer (e.g., from pressure side 140 of airfoil body 136) prior to reaching trailing edge 146. That is, second cooling circuit 202 shields incoming coolant in first cooling circuit 200 from heat transfer in addition to cooling pressure side 140 of airfoil body 136.

Second cooling circuit 202 is somewhat similar in shape to first cooling circuit 200. Second cooling circuit 202 may include a second rearward (feed or inlet) passage 250 extending toward trailing edge 146 (but not reaching it) from and fluidly coupled to coolant feed 204. Second rearward passage 250, which extends generally axially, can have any tubular cross-sectional shape, e.g., circular. Coolant feed 204 coupled to second rearward passage 250 may be a separate coolant feed (see e.g., FIGS. 4-5) from that of first cooling circuit 200, or it may be a shared coolant feed 204 (see e.g., FIG. 8). Second cooling circuit 202 also includes a second radially spreading return passage 252 extending away from trailing edge 146 toward and fluidly coupled to a second coolant reuse passage 206 defined in airfoil body 136. Second coolant reuse passage 206 may be a separate coolant reuse passage 206 (see e.g., FIGS. 4-5) from that of first cooling circuit 200, or it may be a shared coolant reuse passage 206 (see e.g., FIG. 8).

As shown best in FIGS. 5, 7 and 8, radially spreading return passage 252 has a radial extent R5 that is significantly greater than a radial extent R6 of rearward passage 250, e.g., greater than 3 times. As shown in the lower return passage in FIG. 7, a set of obstructions 256, such as a pin or fin bank, may be positioned in second radially spreading return passage 252 to increase cooling, improve structural integrity, and/or control back pressure. As shown best in FIGS. 4 and 5, return passage 252 may be partially or completely between rearward passage 250 and a hot gas path (HGP) 258 about pressure side 140 of airfoil body 136, which limits the amount of energy picked up by coolant in second cooling circuit 202 before entering trailing edge 146. In this manner, most of the coolant's energy is used in trailing edge 146 rather than prior to trailing edge 146. Coolant returning in return passage 252 may be reused in any manner, e.g., film cooling for suction side 142 and/or pressure side 140. As shown in FIGS. 5, 6 and 8, second rearward passage 250 is radially offset from second radially spreading return passage 252 along a radial axis R of airfoil body 136.

Second coolant circuit 202 also includes a second radially extending turn passage 260 (hereafter "turn passage 260") coupling second rearward passage 250 and second radially spreading return passage 252. Turn passage 260 may extend any radial extent R7 (FIGS. 7, 8) necessary to fluidly couple rearward passage 250 and return passage 252 of second cooling circuit 202. As shown best in FIGS. 5 and 8, second rearward passage 250 is radially offset from second radially spreading return passage 252 along radial axis R of airfoil body 136. As illustrated for example in FIG. 8, return passage 252 may fluidly couple to turn passage 250 via a coupling passage 262 that is radially smaller (R8) than return passage 252 (R5), i.e., it has a smaller cross-sectional area. A coolant flow (dark arrows) may travel axially rearwardly through rearward passage 250 from feed passage 204, radially outward in turn passage 260 and then axially forward starting in coupling passage 262 before expanding as it flows axially forward in return passage 252 to reuse passage 206. Coolant flows radially outward in turn passage 260 and over a separating wall 264 between turn passage 260 and return passage 252.

With reference to FIGS. 6 and 7, any number of first or second cooling circuits 200, 202 may be radially positioned in blade 130. That is, blade 130 may include a plurality of the first cooling circuits 200 radially spaced in airfoil body 136 and a plurality of second cooling circuits 202 radially spaced in airfoil body 136. While two of each are shown in FIGS. 6 and 7, any number may be used, i.e., one of each or three or more.

Figure 15:
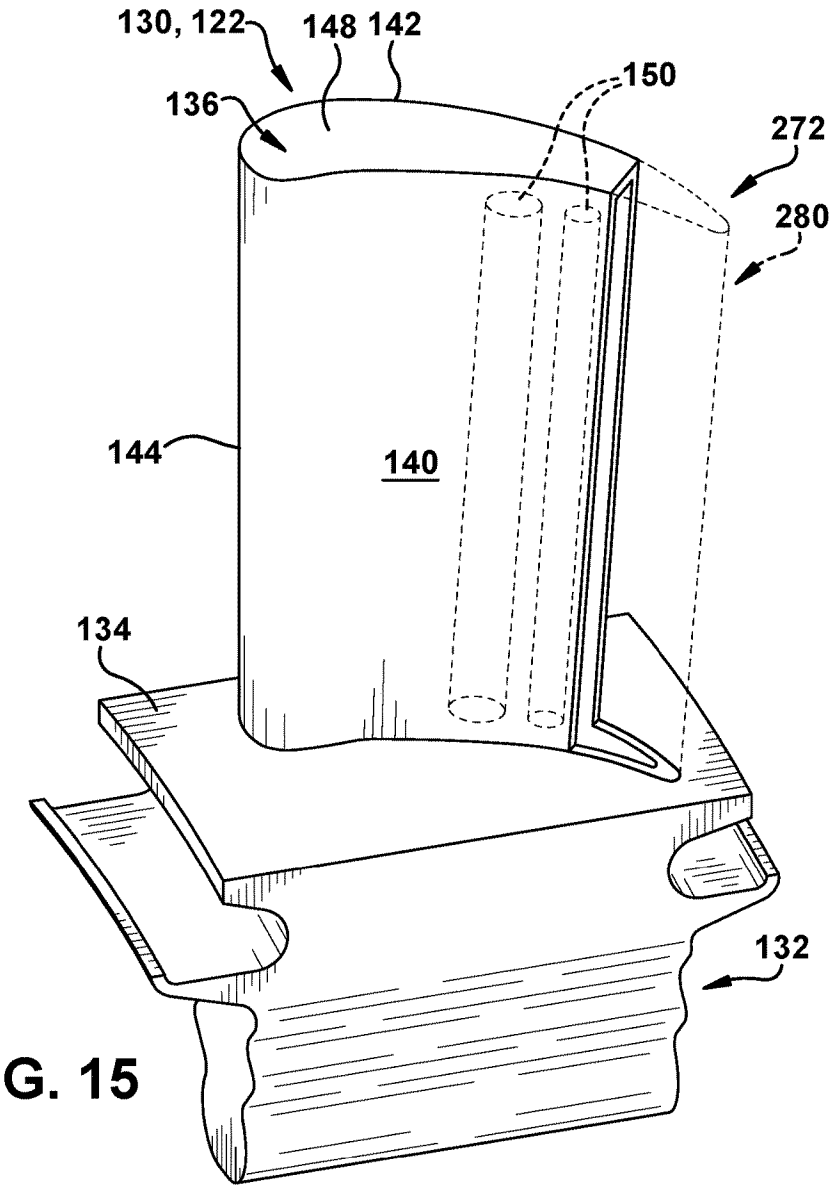
FIG. 15 shows a perspective view of a blade including a cutout for filling with a coupon including cooling circuit(s), according to embodiments of the disclosure.

As noted, embodiments of the disclosure can be used in a turbomachine blade 130 or in a coupon 270 (FIG. 16) that replaces a part of a turbomachine blade, i.e., a part of an airfoil thereof. With reference to FIG. 15, embodiments of a coupon 270 (in dashed lines) for use with a preexisting turbomachine blade 272, such as a rotor blade 130 (FIG. 3), will now be described. FIG. 15 shows a perspective view of a preexisting turbine rotor blade 272 (hereinafter "blade 272"). Blade 272 may include external and internal structure as described relative to turbine rotor blade 130 of FIG. 3. Blade 272 includes airfoil body 136. Airfoil body 136 of blade 272 includes pressure side 140, i.e., a concave pressure side (PS) outer wall, and circumferentially or laterally opposite suction side 142, i.e., a convex suction side (SS) outer wall, extending axially between opposite leading and trailing edges 144, 146, respectively. Pressure side 140 and suction side 142 are connected by leading edge 144 and trailing edge 146 and extend in the radial direction from platform 134 to an outboard tip 148. Outboard tip 148 is shown without a tip shroud (e.g., tip shroud 126 in FIG. 2). A radially extending coolant feed/reuse circuit 150 may extend between walls 140, 142.

Blade 272 is shown with a cutout 280 positioned along the aft end of the airfoil body 136 (that is, a portion encompassing trailing edge 146). As illustrated in the example in FIG. 15, cutout 280 is a predetermined area (shown by dashed lines) that encompasses trailing edge 146 and that is removed from airfoil body 136, i.e., a predetermined portion extending forward from trailing edge 146. Cutout 280 can be removed by any now known or later developed metal cutting technique, e.g., welding torch, electrical discharge machining (EDM), laser cutting, water jet cutting, etc. As illustrated, cutout 280 includes most, if not all, of a radial extent of airfoil body 136. It is emphasized, however, that cutout 280 can include any portion of airfoil body 136 within which first and/or second cooling circuits 200, 202 (FIGS. 4-14) in trailing edge 146 may be desired.

As shown in FIG. 16, coupon 270 is coupled in cutout 280 (FIG. 15) to replace a predetermined area (FIG. 15) of airfoil body 136 that encompasses trailing edge 146. In accordance with embodiments of the disclosure, coupon 270 includes the structure described herein relative to first cooling circuits 200 and, where desired, second cooling circuits 202. More particularly, coupon 270 includes a coupon body 284 including first cooling circuit(s) 200 (FIGS. 4-6 and 8-14) defined therein and, optionally, second cooling circuit(s) 202 (FIGS. 4-5, 7 and 11-14). First cooling circuit 200 and second cooling circuit 202 may be arranged as described herein. Coupon 270 can be the same size as cutout 280 or larger or smaller. The replacement of at least a portion of trailing edge 146 with coupon 270 can enhance performance of existing blades 272 by reducing coolant flow out of trailing edge 146. Coolant used by first and second cooling circuits 200, 202 can be obtained from any coolant feed 204 (see e.g., FIGS. 4-5, 8) and may be reused as described herein.

Figure 17:
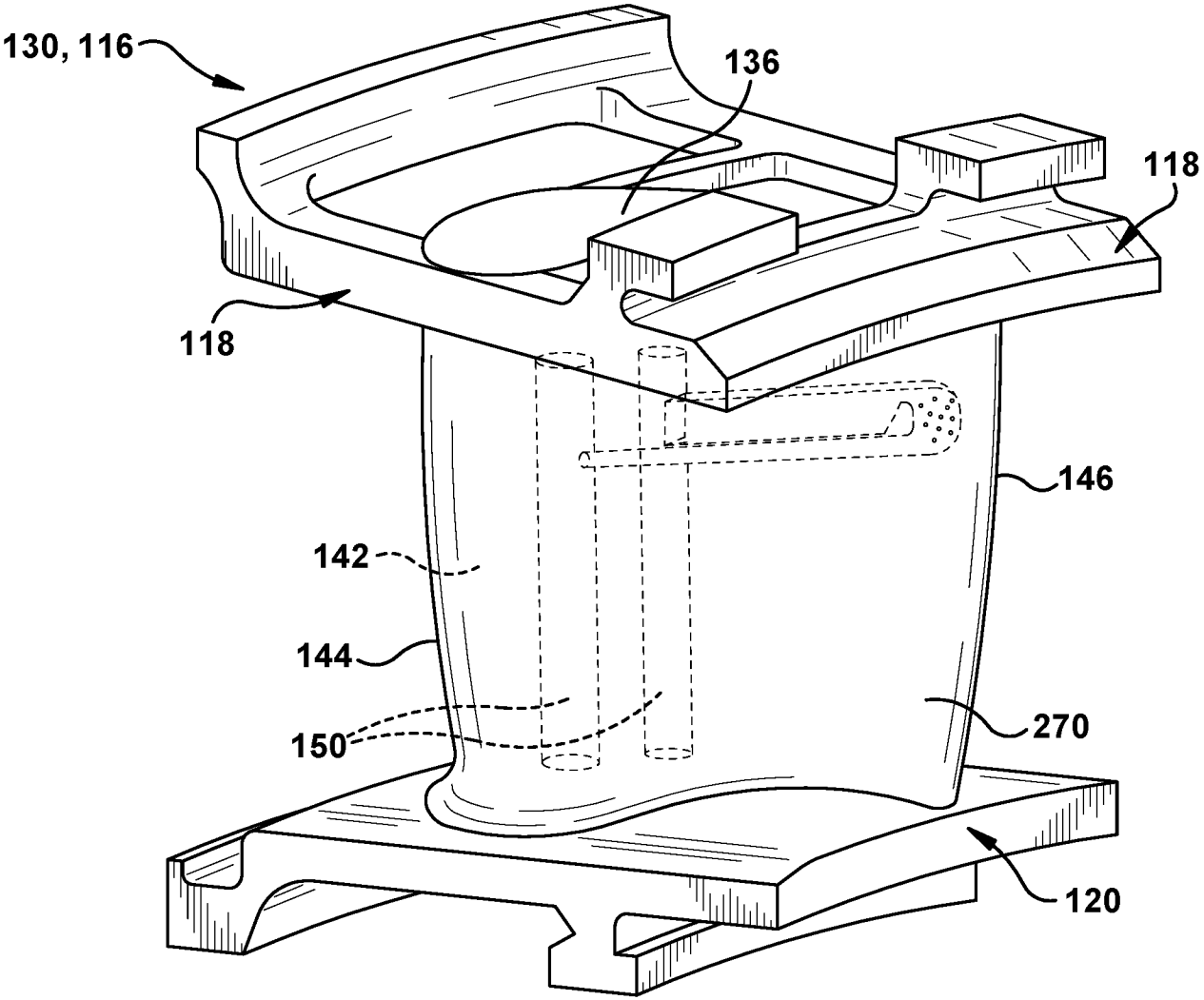
FIG. 17 shows a perspective view of an illustrative turbomachine blade in the form of a turbine nozzle of the type in which embodiments of the disclosure may be employed.

FIG. 17 is a perspective view of a blade 130 in the form of a turbine nozzle 116 of the type in which embodiments of the present disclosure may be employed. Nozzle 116 may be held in turbine assembly 108 (FIG. 2) by radially outer platform 118 and radially inner platform 120. It will be appreciated that airfoil body 136 is the active component of blade 130 (nozzle 116) that intercepts the flow of working fluid and directs the flow where desired. Airfoil body 136 of nozzle 116 includes pressure side 140, i.e., a concave pressure side (PS) outer wall, and a circumferentially or laterally opposite suction side 142, i.e., a convex suction side (SS) outer wall, extending axially between opposite leading and trailing edges 144, 146, respectively. Pressure side 140 and suction side 142 are connected by leading edge 144 and trailing edge 146 and extend in the radial direction from radially inner platform 120 to radially outer platform 118. A radially extending coolant feed/reuse circuit 150 may extend between walls 140, 142. Nozzle 116 may include first cooling circuit 200 (FIGS. 4-6 and 8-14), and optionally second cooling circuit 202 (FIGS. 4-5, 7 and 11-14). A coupon 270, as described relative to FIGS. 15 and 16, may be applied to nozzle 116 in a similar fashion as described relative to turbine rotor blade 122.

Blade 130 (rotating blades and stationary vanes) or coupon 270 may include any metal or metal compound capable of withstanding the environment in which used. Blade 130 and coupon 270 may be made using any now known or later developed manufacturing technique. However, additive manufacturing allows for blade 130 and coupon 270 to be formed with greatly minimized sizes and shapes, e.g., smaller obstructions and thinner walls of airfoil body 136, many of which improve aerodynamic performance. As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of metal, much of which is cut away and discarded, the material used in additive manufacturing is only what is required to shape the part. Additive manufacturing processes may include, but are not limited to: 3D printing, rapid prototyping (RP), direct digital manufacturing (DDM), binder jetting, selective laser melting (SLM) and direct metal laser melting (DMLM). In the current setting, DMLM has been found advantageous.

Figure 18:
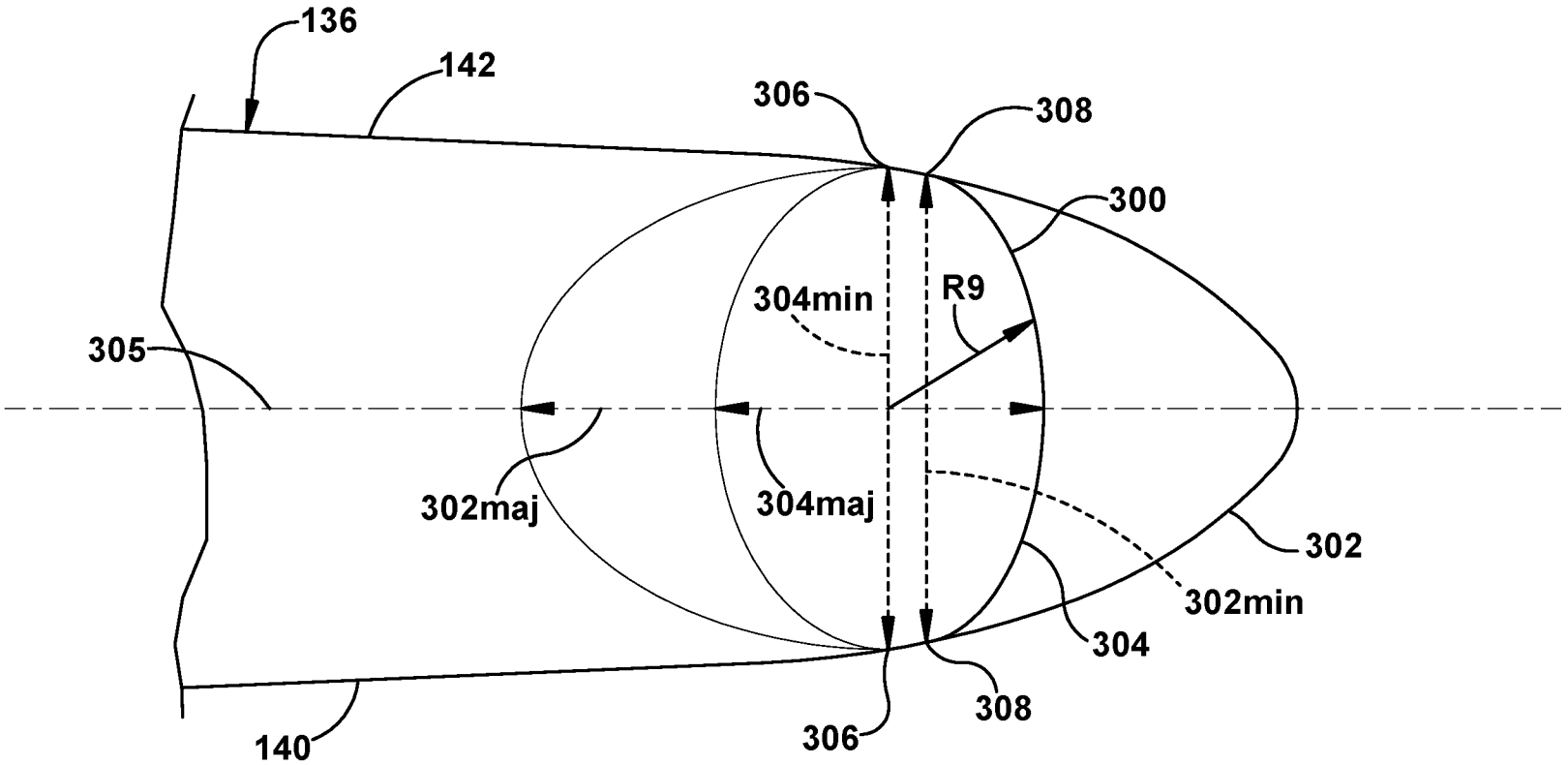
FIG. 18 shows a schematic cross-sectional view of a conventional trailing edge overlaid with a trailing edge according to embodiments of the disclosure.

Embodiments of the disclosure can improve aerodynamic efficiency of turbomachine blades by providing a trailing edge having a sharper turn than conventional blades. FIG. 18 shows a schematic cross-sectional view of a conventional trailing edge 300 overlaid with a trailing edge 302, according to embodiments of the disclosure. As shown, trailing edge 302 is more pointed or sharper than conventional trailing edge 300, the latter of which has a more uniform radius R9 and more square profile. Hence, trailing edge 302 is more highly elliptical. More particularly, a conventional trailing edge 300 typically has an ellipse ratio of less than or equal to 1 as illustrated by the ellipse 304—see major and minor axes labeled 304maj, 304min, respectively. (Ellipse ratio is equal to major axis divided by minor axis. The major axis as defined herein is generally along the mean camber line 305 of airfoil body 136, it is not perpendicular to the mean camber line 305.) The ellipse ratio may be the result of manufacturing of the trailing edge and/or the provision of thermal barrier coatings thereon.

Currently, an ellipse ratio of greater than 1 is challenging to manufacture because it is difficult to sufficiently cool. However, in certain embodiments of the disclosure, an ellipse ratio of trailing edge 302 can be between 1.1 to 4—see major and minor axes labeled 302maj, 302min, respectively. In other embodiments, the ellipse ratio of trailing edge 302 can be between 1.1 to 3. In further embodiments, the ellipse ratio of trailing edge 302 can be between 1.1 to 2. In yet other embodiments, the ellipse ratio of trailing edge 302 can be between 1.1-1.5. For purposes of evaluation, a location of trailing edge 302 may be defined based on where airfoil body 136 transitions from the more linear pressure side 140 or suction side 142 to have more curvature, i.e., with a large gradient in curvature typical of a trailing edge compared to the rest of airfoil body 136. The transition in curvature may be identified, for example, using a curvilinear combs graphical analysis tool available in any now known or later developed computer aided graphics (CAD) design system. In FIG. 18, illustrative transition points for conventional trailing edge 300 are labeled 306, and those for trailing edge 302 are labeled 308.

Embodiments of the disclosure can also improve aerodynamic efficiency of turbomachine blades, e.g., by using thinner walls, with reduced coolant flow to reduce trailing edge temperatures. In addition, the obstructions in the turn passage also provide additional structural strength. Where a coupon is used to provide the cooling circuits to a preexisting blade, the coupons can provide internal cooling structures not previously present in the blade, thus providing improved cooling and aero-performance and lengthening a lifespan of the part.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A turbomachine blade, comprising:

an airfoil body having a pressure side and a suction side connected by a leading edge and a trailing edge;

a coolant feed passage defined in the airfoil body;

a first coolant reuse passage defined in the airfoil body;

a first cooling circuit defined in the airfoil body, the first cooling circuit including:

a first rearward passage extending toward the trailing edge from and directly fluidly coupled to the coolant feed passage;

a first radially spreading return passage extending away from the trailing edge toward and directly fluidly coupled to the first coolant reuse passage, the first radially spreading return passage increasing in dimension in a radial direction over at least a portion of a length of the first radially spreading return passage;

a first radially extending turn passage coupling the first rearward passage and the first radially spreading return passage, the first radially extending turn passage oriented predominantly parallel to the radial direction; and a first set of obstructions positioned in the first radially extending turn passage.

2. The turbomachine blade of claim 1, further comprising a plurality of vent passages extending from the first radially extending turn passage through the trailing edge of the airfoil body.

3. The turbomachine blade of claim 1, wherein the first rearward passage is radially offset from the first radially spreading return passage along a radial axis of the airfoil body.

4. The turbomachine blade of claim 1, further comprising a second set of obstructions positioned in the first radially spreading return passage.

5. The turbomachine blade of claim 1, further comprising:

a second cooling circuit defined in the airfoil body, the second cooling circuit including:

a second rearward passage extending toward the trailing edge from and directly fluidly coupled to the coolant feed passage;

a second radially spreading return passage extending away from the trailing edge toward and directly fluidly coupled to a second coolant reuse passage defined in the airfoil body, the second radially spreading return passage increasing in dimension in a radial direction over at least a portion of a length of the second radially spreading return passage; and a second radially extending turn passage coupling the second rearward passage and the second radially spreading return passage, the second radially extending turn passage oriented predominantly parallel to the radial direction;

wherein the second rearward passage is radially offset from the second radially spreading return passage along a radial axis of the airfoil body.

6. The turbomachine blade of claim 5, wherein the first cooling circuit is circumferentially offset from the second cooling circuit in the airfoil body.

7. The turbomachine blade of claim 5, further comprising a second set of obstructions, wherein the second set of obstructions is positioned in the second radially spreading return passage.

8. The turbomachine blade of claim 5, further comprising a plurality of first cooling circuits radially spaced in the airfoil body, and a plurality of second cooling circuits radially spaced in the airfoil body.

9. The turbomachine blade of claim 1, wherein the trailing edge has an ellipse ratio between 1.1 and 4.

10. The turbomachine blade of claim 5, wherein the first cooling circuit is adjacent the suction side of the airfoil body, and the second cooling circuit is adjacent the pressure side of the airfoil body.

11. The turbomachine blade of claim 1, wherein the first radially extending turn passage has a first circumferential width at a forward end thereof that is greater than a second circumferential width at an aft end thereof.

12. A coupon for replacing a cutout of a predetermined area in an airfoil body of a turbomachine blade, the airfoil body having a pressure side and a suction side connected by a leading edge and a trailing edge, the cutout within the trailing edge of the airfoil body, the coupon comprising:

a coupon body;

a first cooling circuit defined in the coupon body, the first cooling circuit including:

a first rearward passage extending toward the trailing edge from and directly fluidly coupled to a coolant feed passage defined in at least one of the coupon body and the airfoil body;

a first radially spreading return passage extending away from the trailing edge toward and directly fluidly coupled to a first coolant reuse passage defined in at least one of the coupon body and the airfoil body, the first radially spreading return passage increasing in dimension in a radial direction over at least a portion of a length of the first radially spreading return passage;

a first radially extending turn passage coupling the first rearward passage and the first radially spreading return passage, the first radially extending turn passage oriented predominantly parallel to the radial direction; and a first set of obstructions positioned in the first radially extending turn passage.

13. The coupon of claim 12, further comprising a plurality of vent passages extending from the first radially extending turn passage through the trailing edge of the coupon body.

14. The coupon of claim 12, wherein the first rearward passage is radially offset from the first radially spreading return passage along a radial axis of the airfoil body.

15. The coupon of claim 12, further comprising a second set of obstructions, wherein the second set of obstructions is positioned in the first radially spreading return passage.

16. The coupon of claim 12, further comprising:

a second cooling circuit defined in the coupon body, the second cooling circuit including:

a second rearward passage extending toward the trailing edge from and directly fluidly coupled to the coolant feed passage;

a second radially spreading return passage extending away from the trailing edge toward and directly fluidly coupled to a second coolant reuse passage defined in at least one of the coupon body and the airfoil body, the second radially spreading return passage increasing in dimension in a radial direction over at least a portion of a length of the second radially spreading return passage; and a second radially extending turn passage coupling the second rearward passage and the second radially spreading return passage, the second radially extending turn passage oriented predominantly parallel to the radial direction, wherein the second rearward passage is radially offset from the second radially spreading return passage along a radial axis of the airfoil body.

17. The coupon of claim 12, wherein the first cooling circuit is adjacent the suction side of the airfoil body, and the second cooling circuit is adjacent the pressure side of the airfoil body, and wherein the first cooling circuit is circumferentially offset from the second cooling circuit in the at least one of the coupon body and the airfoil body.

18. The coupon of claim 12, wherein the trailing edge has an ellipse ratio between 1.1 and 4.

19. The coupon of claim 12, wherein the first radially extending turn passage has a first circumferential width at a forward end thereof that is greater than a second circumferential width at an aft end thereof.

20. A gas turbine system, comprising:

a compressor;

a combustor; and a gas turbine, the gas turbine including a turbomachine blade including a trailing edge cooling system, the turbomachine blade including:

an airfoil body having a pressure side and a suction side connected by a leading edge and a trailing edge;

a coolant feed passage defined in the airfoil body;

a first coolant reuse passage defined in the airfoil body;

a first cooling circuit defined in the airfoil body, the first cooling circuit including:

a first rearward passage extending toward the trailing edge from and directly fluidly coupled to the coolant feed passage;

a first radially spreading return passage extending away from the trailing edge toward and directly fluidly coupled to the first coolant reuse passage, the first radially spreading return passage increasing in dimension in a radial direction over at least a portion of a length of the first radially spreading return passage;

a first radially extending turn passage coupling the first rearward passage and the first radially spreading return passage, the first radially extending turn passage oriented predominantly parallel to the radial direction; and a first set of obstructions positioned in the first radially extending turn passage.

* * * * *